US010540890B2

(12) United States Patent
Teshima

(10) Patent No.: US 10,540,890 B2
(45) Date of Patent: Jan. 21, 2020

(54) CONSTRUCTION-RELATED INFORMATION ESTIMATION SYSTEM

(71) Applicant: TOYOTA JIDOSHA KABUSHIKI KAISHA, Toyota-shi, Aichi-ken (JP)

(72) Inventor: Shigeharu Teshima, Nagoya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 25 days.

(21) Appl. No.: 15/810,811

(22) Filed: Nov. 13, 2017

(65) Prior Publication Data

US 2018/0165953 A1 Jun. 14, 2018

(30) Foreign Application Priority Data

Dec. 12, 2016 (JP) ..... 2016-240594

(51) Int. Cl.
*G08G 1/01* (2006.01)
*G08G 1/0962* (2006.01)

(52) U.S. Cl.
CPC ..... *G08G 1/0133* (2013.01); *G08G 1/09626* (2013.01); *G08G 1/0116* (2013.01)

(58) Field of Classification Search
CPC ... G06Q 50/08; G08G 1/0133; G08G 1/09626
USPC ..... 340/934
See application file for complete search history.

(56) References Cited

U.S. PATENT DOCUMENTS 6,064,318 A * 5/2000 Kirchner, III .... G08G 1/096716 340/905
6,904,362 B2 * 6/2005 Nakashima ..... G01C 21/3626 340/995.1
7,729,850 B1 * 6/2010 Kraft ..... G01C 21/32 701/414
8,379,923 B2 * 2/2013 Ishikawa ..... G01C 21/32 382/104

(Continued)

FOREIGN PATENT DOCUMENTS

JP 2002-030808 A 1/2002
JP 2003303266 A 10/2003

(Continued)

*Primary Examiner* — Omar Casillashernandez
(74) *Attorney, Agent, or Firm* — Hunton Andrews Kurth LLP

(57) ABSTRACT

A construction-related information estimation system includes a moving body correspondence information terminal configured to move together with a moving body that moves on a target road, the target road being a road on which a construction site that is a place which is estimated to be under a construction is located or that is located near the construction site, and transmit terminal information including a terminal ID signal that is its own identification information and its own position information, and an information processing device configured to have map information including information on the construction site and the target road and receive the terminal ID signal and the position information transmitted from the moving body correspondence information terminal. The information processing device is configured to estimate a current situation of the target road based on the terminal information and the map information acquired from the moving body correspondence information terminal.

10 Claims, 14 Drawing Sheets

(56) References Cited

U.S. PATENT DOCUMENTS

| | | | | |
|---|---|---|---|---|
| 2003/0083079 | A1* | 5/2003 | Clark | G08G 1/096716 455/466 |
| 2004/0236498 | A1* | 11/2004 | Le | G01C 21/3629 701/440 |
| 2006/0116965 | A1* | 6/2006 | Kudo | G06Q 99/00 705/52 |
| 2007/0294031 | A1* | 12/2007 | Brinton | G08G 1/096805 701/527 |
| 2011/0040478 | A1* | 2/2011 | Rinscheid | G01C 21/3688 701/532 |
| 2013/0332056 | A1* | 12/2013 | Huang | H04W 4/029 701/117 |
| 2014/0214715 | A1* | 7/2014 | Crocker | G06Q 10/047 705/333 |
| 2016/0284211 | A1* | 9/2016 | Suzuki | G08G 1/0112 |
| 2017/0242436 | A1* | 8/2017 | Creusot | G08G 1/005 |

FOREIGN PATENT DOCUMENTS

| | | | |
|---|---|---|---|
| JP | 2004205344 | A | 7/2004 |
| JP | 2008-052461 | A | 3/2008 |
| JP | 2009217826 | A | 9/2009 |
| JP | 2012103241 | A | 5/2012 |
| JP | 2015063223 | * | 2/2015 |
| JP | 2016171377 | A | 9/2016 |
| JP | 2016184236 | A | 10/2016 |

* cited by examiner

DM-C
(31D)

TRAFFIC REGULATION INFORMATION : LANE R1-1 IS UNDER ONE-WAY TRAFFIC REGULATION
ROAD R1-2 (LANE R1-2-B) IS UNDER ONE-SIDED ALTERNATE TRAFFIC REGULATION
LANE R2-A IS UNDER LANE REGULATION
ROAD R4 IS UNDER TRAFFIC STOP REGULATION
TRAFFIC JAM IS BEING GENERATED IN LANE R2-A

CONSTRUCTION-RELATED INFORMATION ESTIMATION SYSTEM

INCORPORATION BY REFERENCE

The disclosure of Japanese Patent Application No. 2016-240594 filed on Dec. 12, 2016 including the specification, drawings and abstract is incorporated herein by reference in its own entirety.

BACKGROUND

1. Technical Field

The present disclosure relates to a construction-related information estimation system capable of estimating a current situation of a target road which is a road on which a construction site is located or a road located near the construction site.

2. Description of Related Art

Japanese Unexamined Patent Application Publication No. 2008-52461 (JP 2008-52461 A) discloses a technique in which a constructor that performs a power distribution construction releases, on the Internet, information on a work situation or the like which is transmitted from a construction site using an information terminal. Therefore, persons related to the construction or persons other than the persons related to the construction can acquire the information on the construction situation or the like released on the Internet using their information terminals in real time.

SUMMARY

A road on which a construction site of a power distribution construction is located and a road located near the construction site are affected by the construction situation. That is, on the above-described road, vehicles of the constructors who perform the power distribution work are parked, signboards informing content of the power distribution work, and the like are installed. Therefore, the situation of the above-described road is relatively highly likely to become a situation different from that at a normal time at which the construction is not performed. That is, on the above-described road, vehicles are likely to cause traffic jam due to an influence of parked vehicles and/or installed signboards. Further, the above-described road is likely to be, for example, under a traffic stop regulation, a one-way traffic regulation, or a one-sided alternate traffic regulation.

However, in the technique of JP 2008-52461 A, the persons related to the construction or the persons other than the persons related to the construction cannot acquire information on a current situation of the above-described road using the information terminals. Therefore, the persons related to the construction or the persons other than the persons related to the construction cannot recognize the current situation of the above-described road.

The present disclosure provides a construction-related information estimation system capable of estimating a current situation of a target road which is a road on which a construction site is located or a road located near the construction site.

An aspect of the disclosure relates to a construction-related information estimation system including a moving body correspondence information terminal that is configured to move together with a moving body that moves on a target road, the target road being a road on which a construction site that is a place which is estimated to be under a construction is located or a road that is located near the construction site, and transmit terminal information including a terminal ID signal that is its own identification information and its own position information, and an information processing device configured to have map information including information on the construction site and the target road and receive the terminal ID signal and the position information transmitted from the moving body correspondence information terminal. The information processing device is configured to estimate a current situation of the target road based on the terminal information and the map information acquired from the moving body correspondence information terminal.

According to the aspect of the present disclosure, for example, a pedestrian, and a vehicle (including a car, a bicycle, and a motorcycle) can be a moving body. For example, a smartphone, a tablet computer, and a laptop personal computer can be used as the moving body correspondence information terminal.

According to the aspect of the present disclosure, the information processing device estimates a current situation of the target road based on terminal information (terminal ID signal and position information) and map information acquired from the moving body correspondence information terminal that moves on the target road together with the moving body. For example, when a rate of change in position of the moving body is relatively small, the information processing device estimates that vehicles cause traffic jam on the target road. Therefore, when the estimation result output by the information processing device is released, for example, on the Internet (Web), unspecified majority can recognize that vehicles cause traffic jam on a current target road.

The aspect of the present disclosure can easily be understood from the description of embodiments of the present disclosure that are described with reference to the following drawings.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
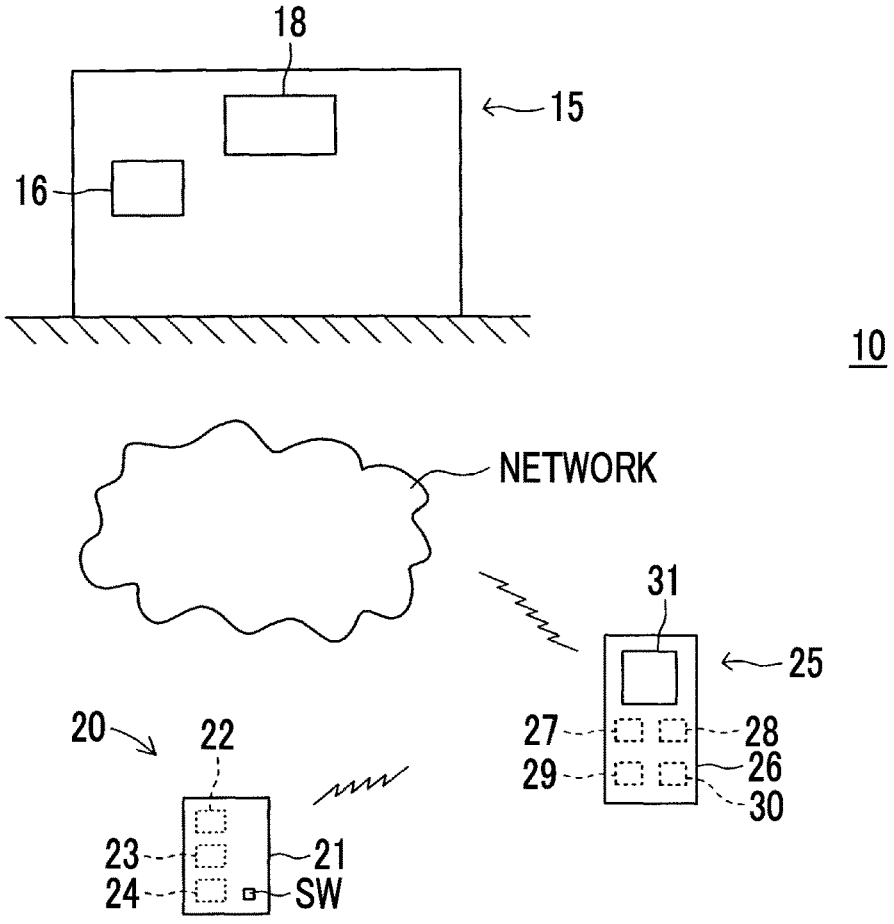
FIG. 1 is a diagram illustrating a construction-related information estimation system according to an embodiment of the present disclosure.

Hereinafter, a construction-related information estimation system 10 according to an embodiment of the present disclosure will be described with reference to the accompanying drawings. The construction-related information estimation system 10 of the embodiment includes, as primary components, a data center 15, a beacon 20, and a smartphone 25, as illustrated in FIG. 1. As described below, in the embodiment, a plurality of beacons are used. That is, beacons 20-1 (20-1-1 to 20-1-6) and beacons 20-2 (20-2-1 to 20-2-5) are used. In some cases, each beacon may be specified using reference signs 20-1 (20-1-1 to 20-1-6), 20-2 (20-2-1 to 20-2-5). Further, all the beacons may be specified using reference sign "20". Similarly, in the embodiment, a plurality of smartphones is used. That is, the smartphones 25CS1, 25CS2, 25CS4, 25A, 25B, 25C, 25D, 25E are used. The respective smartphones may be specified using the reference signs 25CS1, 25CS2, 25CS4, 25A, 25B, 25C, 25D, 25E. Further, all the smartphones may be specified using the reference sign "25". The smartphone functions as a moving body correspondence information terminal, a distance estimation information terminal, a construction-related information terminal, and an information terminal.

The data center 15 includes an information processing device 16 (computer server) and a display 18.

As illustrated in FIG. 1, the information processing device 16 of the data center 15 performs data communication with each smartphone 25 over the network. The network includes a communication network of a communication operator, and the Internet. Each smartphone 25 performs wireless communication (data communication) with a base station of the communication operator. The base station is connected to the Internet over a communication network of the communication operator. The information processing device 16 performs data communication with the Internet network. As will be described below, each smartphone 25 can receive radio waves transmitted by the beacon 20.

The information processing device 16 installed in a building of the data center 15 is an electronic control circuit including, as a main component, a microcomputer including a CPU, a ROM, a RAM, an interface, and the like. The CPU realizes various functions to be described below by executing instructions stored in a memory (ROM). Map data and various types of software to be described below are recorded in the memory. As well known, the CPU executes respective operations to be described below by executing instructions of each software.

Figure 3:
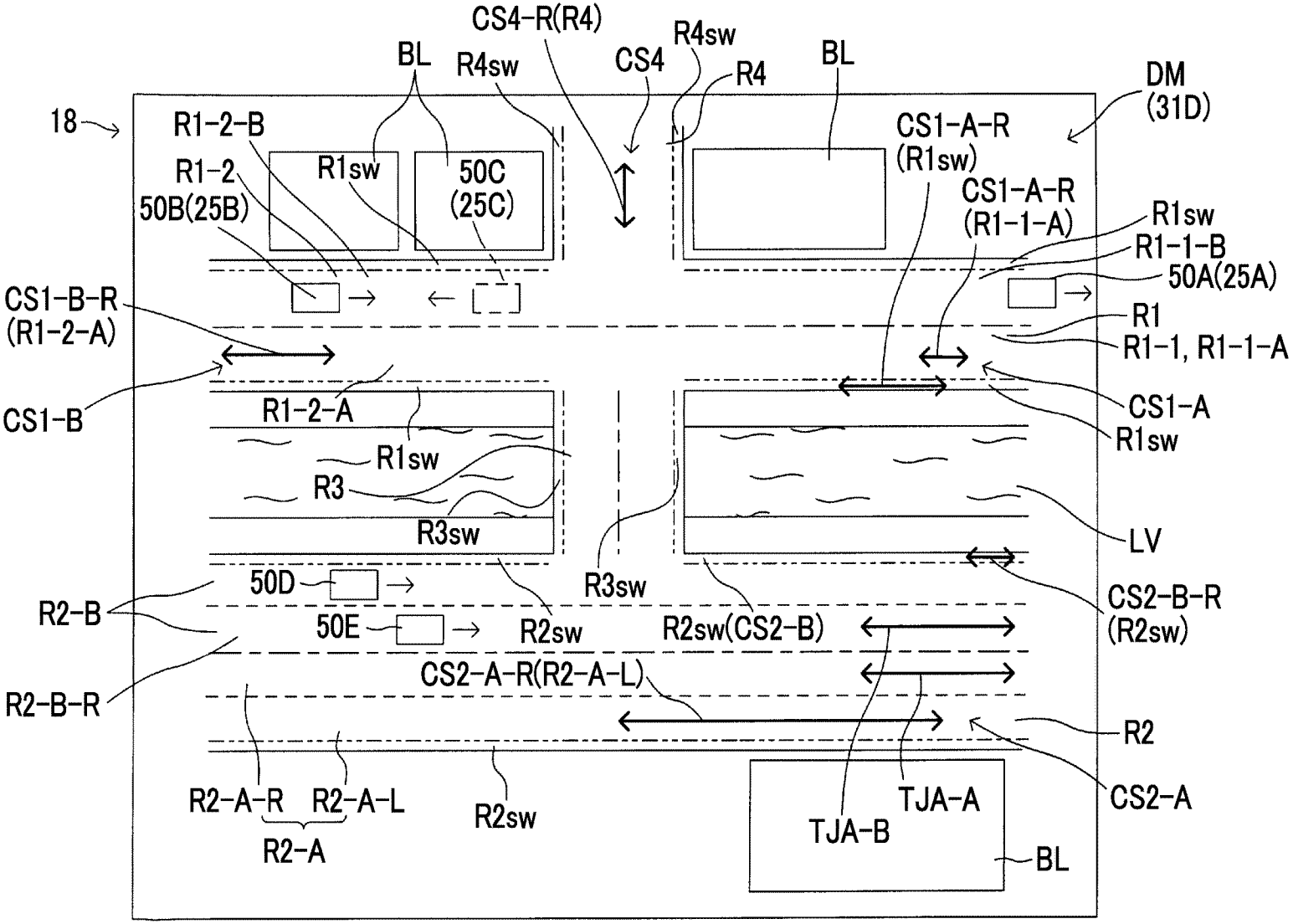
FIG. 3 is a diagram illustrating a display state of a display of a data center and a smartphone.
Figure 4:
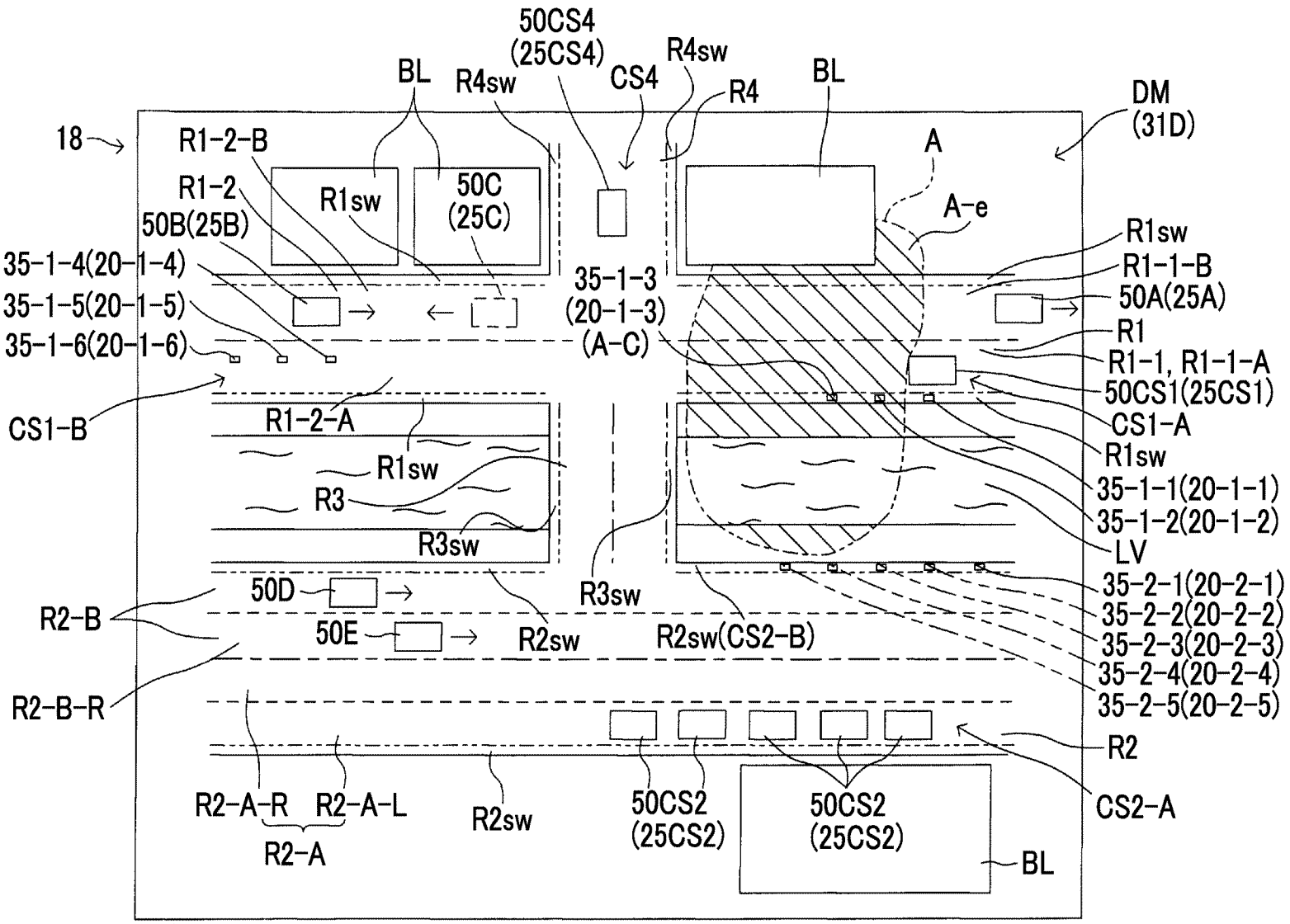
FIG. 4 is a diagram illustrating a display state of a display of a data center and a smartphone.

A dynamic map DM illustrated in FIGS. 3 and 4 is displayed on the display 18 connected to the information processing device 16. The dynamic map DM includes a plurality of layers superimposed to one another. A degree of change of information represented by each layer according to a time change differs among the respective layers. As will be described below, various types of information are displayed in the dynamic map DM. However, it is difficult to represent all of the pieces of information using solely FIG. 3 or 4, and the dynamic map DM will be described using FIGS. 3 and 4 in the embodiment, for convenience. The layer including the smallest change according to the time change (substantially is not changed) is a map image based on the map data. The other layers represent information that is changed according to the time change. For example, one layer separate from the map image represents position information of the beacon 20 and the smartphone 25.

As illustrated in FIG. 3, the map image represents a specific area around the data center 15. The map image includes an image of two parallel roads R1, R2. Further, the map image includes roads R3, R4 orthogonal to the roads R1, R2. Further, the road R1 is divided into a road R1-1 and a road R1-2 at an intersection that intersects the roads R3, R4. In any of the roads R1, R2, R3, R4, vehicles (including cars, bicycles, and motorcycles) and pedestrians can pass. Hereinafter, the respective roads are referred to as target roads R1, R2, R3, R4. The target roads R1, R2, R3 are partitioned into two lanes (groups) by a central separation line drawn by a one-dot chain line. That is, due to regulations of the road traffic law, the vehicle can travel in one direction on a road located on one side of the central separation line of the target roads R1, R2, R3, and the vehicle can travel in the other direction on a road located on the other side of the central separation line of the target roads R1, R2, R3. The vehicle passes on the left lane of the target roads R1, R2, R3. The target road R2 is two lanes on one side (a broken line indicates a boundary line between the two lanes). The target roads R1 and R3 are one lane on one side. There is no central separation line in the target road R4. Due to regulations of a road traffic law, the target road R4 is a one-way road (a vehicle can pass on the target road R4 solely from an upper side to a lower side in FIGS. 3 and 4). Regulation information of the road traffic law regarding the target roads R1, R2, R3 is recorded in the dynamic map DM (and the map image 31D to be described below) as data. A two-dot chain line indicates a guard rail. That is, sidewalks R1*sw*, R2*sw*, R3*sw*, R4*sw* adjacent to the target roads R1, R2, R3, R4 are formed outside each guard rail. The target road R3 is a bridge. A river LV parallel to the target roads R1, R2 flows under the target road R3. Further, an image of a plurality of buildings (for example, houses, buildings, or factories) BL is included the map image.

The map image includes a plurality of grids (minimum grid-like units own). A length of each side of the grid is a distance corresponding to 2 m in an actual geography. Therefore, as described below, when a current position (estimated position A-C) of the beacon 20 and the current position of the smartphone 25 displayed to be superimposed on the map image of the dynamic map DM are obtained, the current position is a position corresponding to one grid.

The beacon 20 illustrated in FIG. 1 is a small and lightweight tag. An IC chip 22, a battery 23, and an antenna (an example of a transmission unit) 24 are provided inside a casing 21 constituting an outer shape of the beacon 20. Further, a main switch SW is provided on an outer surface of the casing 21.

The IC chip 22 is a small electronic component including one substrate, and a plurality of electronic components (for example, transistors, resistors, capacitors, and diodes) mounted on the substrate. The IC chip 22 has a function of generating a radio signal (radio waves). A standard of the radio waves generated by the IC chip 22 is Bluetooth Low Energy. That is, the IC chip 22 generates radio waves in a 2.4 GHz band. The IC chip 22 generates a radio signal at predetermined time intervals (for example, in every 100 milliseconds). Further, each time the IC chip 22 generates a radio signal, the IC chip 22 generates a beacon ID signal for identifying the beacon 20 from other beacons.

The battery 23 is a button type battery. When the main switch SW is located at an ON position, the battery 23 always supplies power to the IC chip 22 and the antenna 24 until a capacity thereof becomes zero. Since a standard of the radio wave generated by the IC chip 22 is Bluetooth Low Energy, power consumption per unit time of the battery 23 is relatively low. When the main switch SW is located at an OFF position, the battery 23 does not supply the power to the IC chip 22 and the antenna 24.

Further, the antenna 24 is connected to the IC chip 22. When the IC chip 22 to which the power of the battery 23 is supplied generates a radio signal, the antenna 24 repeatedly transmits the generated radio signal to the outside together with the beacon ID signal at predetermined time intervals (for example, in every 100 milliseconds). Hereinafter, a transmission period of the radio signal using the beacon 20 is referred to as a "beacon transmission period".

Further, when the IC chip 22 generates the radio waves (that is, for example, in every 100 milliseconds), the IC chip 22 generates a reference intensity signal indicating an intensity of the radio wave. The radio wave intensity (reference intensity) indicated by the reference intensity signal is a radio wave intensity of the radio waves received by a receiver (for example, a smartphone) when the receiver receives the radio wave transmitted by the antenna 24 at a distance separated by 1 m from the beacon 20.

One reference intensity signal and one beacon ID signal are superimposed as one set on the radio signal generated by the IC chip 22. One set including the reference intensity signal and the beacon ID signal can be superimposed on the radio signal, for example, as a payload. The antenna 24 transmits the radio waves together with the beacon ID signal and the reference intensity signal.

Figure 2:
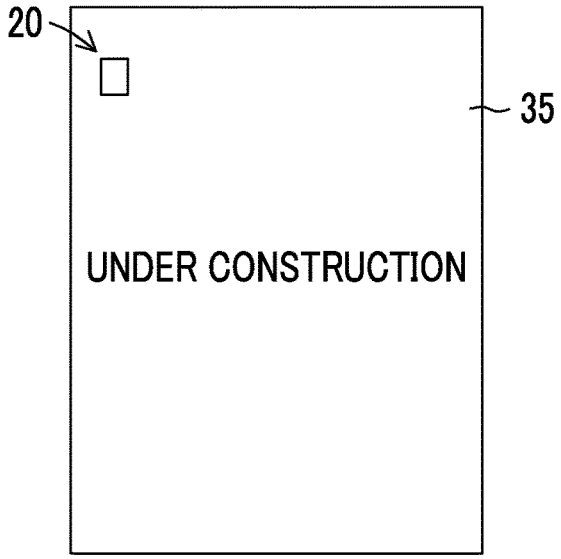
FIG. 2 is a diagram illustrating beacon and a signboard to which the beacon is attached.

In the embodiment, the beacons 20 are detachably attached to the freestanding signboards 35 illustrated in FIGS. 2 and 4 one by one. In the embodiment, the same number of signboards 35 as the that of beacons 20 are used. That is, the signboards 35-1 (35-1-1 to 35-1-6) and the signboards 35-2 (35-2-1 to 35-2-5) are used. The respective signboards may be specified using the reference signs 35-1 (35-1-1 to 35-1-6) and 35-2 (35-2-1 to 35-2-5). Further, all the signboards are specified using the reference sign "35". The signboards 35 are installed in respective construction scheduled sites CS1-A, CS1-B, CS2-B which will be described below.

An ECU 27, a battery 28, a wireless communication antenna 29, and a GPS reception antenna 30 are provided inside a casing 26 constituting the outer shape of the smartphone 25 illustrated in FIG. 1.

The ECU 27 (electronic control unit) is an electronic control circuit including, as a main component, a microcomputer including a CPU, a ROM, a RAM, an interface, and the like. The CPU realizes various functions to be described below by executing instructions stored in a memory (ROM). Further, various types of software (applications) are installed in the memory of the ECU 27. For example, a "target road information acquisition application" is installed in the memory.

The ECU 27 can generate a radio signal. Further, the ECU 27 can repeatedly generate a terminal ID signal for identifying each smartphone 25 from another smartphone 25 at predetermined time intervals.

The battery 28 is a rechargeable battery, and always supplies power the ECU 27, the wireless communication antenna 29, the GPS reception antenna 30, and the display 31 until a capacity of the battery 28 becomes zero.

The wireless communication antenna 29 is connected to the ECU 27. When the smartphone 25 is located within the range in which the radio signal that is transmitted by the beacon 20 can reach, the wireless communication antenna 29 repeatedly receives the radio signal, the beacon ID signal, and the reference intensity signal transmitted by the beacon 20 at predetermined time intervals (for example, in every 100 milliseconds). Hereinafter, a reception period of the radio signal, the beacon ID signal, and the reference intensity signal transmitted by the beacon 20 in the wireless communication antenna 29 is referred to as a "beacon transmission information reception period". The beacon transmission information reception period can be, for example, the same as the beacon transmission period. Further, the ECU 27 records the received beacon ID signal and reference intensity signal in the RAM in time series.

The GPS reception antenna 30 is connected to the ECU 27. As is well known, the GPS reception antenna 30 repeatedly acquires position information (hereinafter referred to as "GPS position information") on a position of the GPS reception antenna 30 (the smartphone 25) at predetermined time intervals (for example, in every seconds) by receiving a GPS signal transmitted from a GPS satellite. Hereinafter, a reception period of the GPS position information in the GPS reception antenna 30 is referred to as a "GPS information reception period". Further, the ECU 27 records the received GPS position information in the RAM in time series in the same period as the GPS information reception period, for example.

Further, the wireless communication antenna 29 repeatedly wirelessly transmits, for example, the beacon ID signal, the GPS position information, and the terminal ID signal recorded in the RAM to the outside, for example, at the same period as the GPS information reception period according to an instruction from the ECU 27, as will be described below. Further, the wireless communication antenna 29 can receive a radio signal transmitted by the base station.

Further, the display 31 is provided on a surface of the casing 26. The display 31 is also connected to the ECU 27. Further, input means (not illustrated) connected to the ECU 27 is provided on the surface of the smartphone 25. A format of the input means is not limited. That is, the input means may be, for example, a mechanical button that is movable relative to the casing 26, or may be a touch panel forming a part of the display 31.

In the embodiment, the smartphones 25 are respectively located inside the plurality of vehicles 50. An occupant of each vehicle 50 can operate each smartphone 25. The vehicle 50 of the embodiment is a car. The respective vehicles may be specified using reference signs 50CS1, 50CS2, 50CS4, 50A, 50B, 50C, 50D, 50E. Further, all the vehicles may be specified using a reference sign "50". Further, in the following description, the smartphones moving together with the respective vehicles 50CS1, 50CS2, 50CS4, 50A, 50B, 50C, 50D, 50E are the smartphones 25CS1, 25CS2, 25CS4, 25A, 25B, 25C, 25D, 25E, respectively.

The respective vehicles 50 can broadly be divided into vehicles 50CS1, 50CS2, 50CS4 and vehicles 50A, 50B, 50C, 50D, 50E. The vehicles 50CS1, 50CS2, 50CS4 are vehicles owned by the constructors who perform the construction in an area represented by the map image illustrated in FIG. 3 (FIG. 4). On the other hand, the vehicles 50A, 50B, 50C, 50D, 50E are vehicles that are driven by general drivers (in other words, drivers who are not the constructors).

Next, an overview of an operation of the construction-related information estimation system 10 will be described. The following description is based on the premise that the following states 1 to 4 are realized. State 1: The capacity of the battery 23 of the beacon 20 and the battery 28 of the smartphone 25 is not zero. State 2: The main switch SW of the beacon 20 other than the beacons 20-2-2 to 20-2-5 and the power switch of the smartphone 25 are in an ON state. In other words, the main switches SW of the four beacons 20-2-2 to 20-2-5 are in an OFF state. State 3: The ECUs 27 of all the smartphones 25 read the target road information acquisition application. As a result, substantially the same map image 31D (see FIGS. 3 and 4) as the dynamic map DM in FIGS. 3 and 4 is displayed on the display 31. State 4: The signboard 35 (the beacon 20) and the vehicles 50A, 50B, 50C, 50D, 50E (smartphones 25) are located in a certain area (an area that can be displayed on the dynamic map DM and the map image 31D).

The constructor installs the respective signboards 35-1 (35-1-1 to 35-1-6) and the respective signboards 35-2 (35-2-1 to 35-2-5) to which the beacons 20 have been attached, respectively, at the respective construction scheduled sites CS1-A, CS1-B, CS2-B displayed to be superimposed on the map image of the dynamic map DM. The signboards 35-1-1 to 35-1-3 are installed in a state in which the signboards 35-1-1 to 35-1-3 are aligned at predetermined intervals on a sidewalk R1*sw* provided at a side edge portion of the target road R1-1. That is, a part of the sidewalk R1*sw* is a construction scheduled site CS1-A. The signboards 35-1-4 to 35-1-6 are installed in a state in which the signboards 35-1-4 to 35-1-6 are aligned at predetermined intervals on one lane R1-2-A of the target road R1-2. That is, a part of the lane R1-2-A of the target road R1-2 is the construction scheduled site CS1-B. The signboards 35-2-1 to 35-2-5 are installed in a state in which the signboards 35-2-1 to 35-2-5 are aligned at predetermined intervals on the sidewalk R2*sw* provided at a side edge portion of the target road R2. That is, a part of the sidewalk R2*sw* is the construction scheduled site CS2-B.

Further, constructors park the vehicles 50CS1, 50CS2, 50CS4 moved on any one of the target roads R1, R2, R3, R4 at the construction scheduled site or near the construction scheduled site displayed to be superimposed on the map image of the dynamic map DM. One vehicle 50CS1 is parked on one lane R1-1-A of the target road R1-1 to face the signboard 35-1-1 in a width direction of the target road R1-1. The lane R1-1-A is located near the sidewalk R1*sw* (the construction scheduled site CS1-A). The five vehicles 50CS2 are parked in a state in which the vehicles 50CS2 are aligned at predetermined intervals on the left lane R2-A-L in one lane R2-A (with the left lane R2-A-L and the right lane R2-A-R) of the target road R2. That is, a part of the left lane R2-A-L is the construction scheduled site CS2-A. One vehicle 50CS4 is parked on the target road R4. That is, a part of the target road R4 is the construction scheduled site CS4. As described above, each of the smartphones 25CS1, 25CS2, 25CS4 moves together with each of the vehicles 50CS1, 50CS2, 50CS4. That is, the smartphones 25CS1, 25CS2, 25CS4 are respectively placed in the vehicles 50CS1, 50CS2, 50CS4. p The constructor requests a local government for the area indicated by the map image (dynamic map DM) in FIG. 3 to provide places of the respective construction scheduled sites CS1-A, CS1-B, CS2-A, CS2-B, CS4, a construction period, and construction content in advance. Further, the data center 15 acquires the requested information from the local government in advance, and the requested information is input to the dynamic map DM in advance.

In the embodiment, the radio signal emitted from the beacon 20 other than the beacons 20-2-2 to 20-2-5 attached to the respective signboards 35 reaches a destination at tens of meters from each beacon 20. In other words, when the smartphone 25 is located inside a circle having a radius of tens of meters around each beacon 20 other than the beacons 20-2-2 to 20-2-5, the radio signal transmitted by each beacon 20 is received by the smartphone 25. For example, the radio signals transmitted from the respective beacons 20-1-1 to 20-1-3 are received by the smartphone 25CS1 placed inside the vehicle 50CS1 and the smartphone 25A placed inside the vehicle 50A. The radio signals respectively transmitted by the respective beacons 20-1-4 to 20-1-6 are received by the smartphones 25B, 25C placed inside, for example, the vehicles 50B, 50C traveling on one lane R1-2-B of the target road R1-2. Further, the radio signal transmitted by the beacon 20-2-1 is received by the five smartphones 25CS2 placed inside the five vehicles 50CS2, respectively.

When the wireless communication antenna 29 of the smartphone 25 receives the radio signal, the beacon ID signal, and the reference intensity signal transmitted by each beacon 20 other than the beacons 20-2-2 to 20-2-5, the ECU 27 compares the intensity of the actually received radio signal (hereinafter referred to as an "actual intensity") with the reference intensity indicated by the reference intensity signal. Based on the actual intensity and the reference intensity, the ECU 27 calculates (estimates) an estimated distance that is a distance between the smartphone 25 and the beacon 20.

Specifically, the ECU 27 calculates the estimated distance as follows. For example, when the actual intensity is greatly higher than the reference intensity, the ECU 27 estimates that "the estimated distance is an immediately area". The immediately area is an area in which a distance between the beacon 20 and the smartphone 25 is very short (for example, is an area in which the distance is equal to or smaller than 1 m). When the actual intensity is slightly higher than the reference intensity, the ECU 27 estimates that "the estimated distance is in the near area". The near area is an area in which the distance between the beacon 20 and the smartphone 25 is short and is longer than that of the immediately area (for example, is an area in which the distance is greater than 1 m and equal to or smaller than 3 m). When the actual intensity is lower than the reference intensity, the ECU 27 estimates that "the estimated distance is in the far area." The far area is an area in which the distance between the beacon 20 and the smartphone 25 is longer than that of the near area (for example, is an area in which the distance is greater than 3 m and equal to or smaller than 10 m). However, a relationship between a height relationship between the actual intensity and the reference intensity, and the three estimated distances is not limited to this relationship.

When the ECU 27 of the smartphone 25 repeatedly calculates the estimated distance at predetermined time intervals (for example, in every 100 milliseconds), the ECU 27 records the calculated estimated distance together with the reference intensity signal and the beacon ID signal in the RAM at predetermined time intervals (for example, in every milliseconds) in time series.

Incidentally, the ECU 27 records the received GPS position information in the RAM in time series at the same period as the GPS information reception period, as described above. When the ECU 27 records one GPS position information on the RAM, the ECU 27 records the estimated distance calculated by the ECU 27 between the GPS information reception periods when the GPS position information is received by the GPS reception antenna 30, the beacon ID signal, and the reference intensity signal received by the wireless communication antenna 29 on the RAM as a set with the GPS position information. As described above, the GPS information reception period is longer than the beacon transmission information reception period, and a plurality of beacon transmission information reception periods elapses while one GPS information reception period is elapsing. Thus, one piece of GPS position information, a plurality of estimated distances, a plurality of reference intensity signals, and a plurality of beacon ID signals are recorded on the RAM as one set. For example, when the GPS information reception period is one second and the beacon transmission information reception period is 100 milliseconds, one piece of GPS position information, ten estimated distances, ten reference intensity signals, and ten beacon ID signals are recorded on the RAM as one set. Hereinafter, the one set is referred to as "the estimated distance and the GPS information set".

Further, the wireless communication antenna 29 repeatedly transmits the GPS position information (or the estimated distance and GPS information set), and the terminal ID signal together as one set to the information processing device 16 of the data center 15, for example, in the same predetermined period (for example, one second) as the GPS information reception period according to the instruction from the ECU 27.

The information processing device 16 receives the GPS position information (or the estimated distance and GPS information set) and the terminal ID signal from the smartphones 25, for example, in a center reception period having the same length as the GPS information reception period, and records the GPS position information (or the estimated distance and GPS information set) and the terminal ID signal in the RAM in a predetermined period (for example, the same period as the center reception period). When the information processing device 16 receives the estimated distance and the GPS information set from each smartphone 25, the information processing device 16 estimates the current position of the beacon 20 (the signboard 35) corresponding to the received beacon ID signal according to the following principle illustrated in FIGS. 6 and 7 based on information on a plurality of estimated distances.

Figures 5, 6:
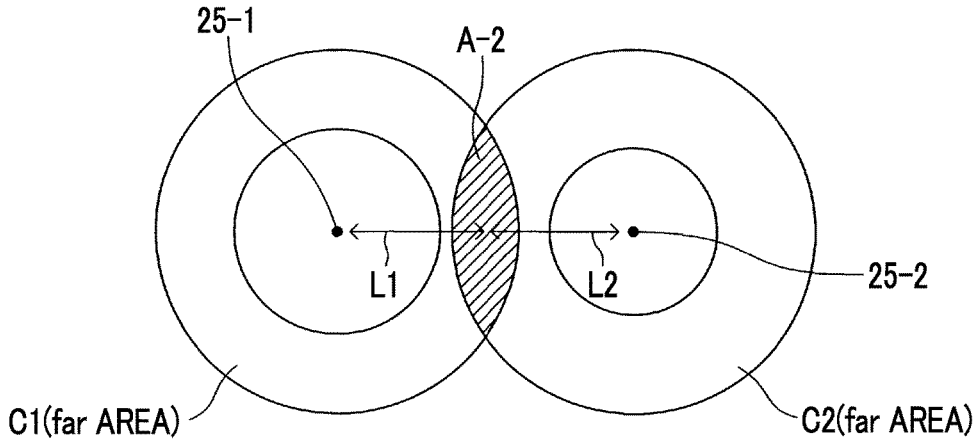
FIG. 5 is a diagram illustrating a current situation display portion of a road that is a part of a dynamic map.
FIG. 6 is a diagram illustrating a principle of estimating a position of a beacon in an information processing device of a data center based on an estimated distance from each smartphone to the beacon calculated by two smartphones based on a radio signal transmitted by the beacon.

For example, when the information processing device 16 receives the estimated distance and the GPS information set from only two smartphones 25 (25-1, 25-2) together with the corresponding terminal ID signal in the center reception period, the information processing device 16 obtains a range estimated to include the current position of the beacon 20 based on the principle illustrated in FIG. 6. That is, the information processing device 16 obtains a provisional estimated area A-2 in which an annular band C1 that is around the smartphone 25-1 and has an outer diameter that is an upper limit value of the estimated distance L1 (far area) calculated by the smartphone 25-1 and an inner diameter that is a lower limit value thereof, and an annular band C2 that is around the smartphone 25-2 and has an outer diameter that is an upper limit value of the estimated distance L2 (far area) calculated by the smartphone 25-2 and an inner diameter that is a lower limit value thereof overlap. The provisionally estimated area A-2 is a range estimated to include the current position of the beacon 20. For example, when the estimated distance L1 is an immediately area, an area in which a circle C1 having a radius which is an upper limit value of the estimated distance L1, and the annular band C2 overlap is the provisionally estimated area A-2.

Typically, a plurality of estimated distances are included in one estimated distance and the GPS information set that the information processing device 16 has received from the smartphones 25-1, 25-2. Therefore, when the information processing device 16 receives one estimated distance and the GPS information set from the smartphones 25-1, 25-2, the information processing device 16 typically calculates four or more provisionally estimated areas A-2. The provisionally estimated areas A-2 are calculated based on the radio signals with the same radio wave intensity transmitted by the beacon 20. Therefore, shapes of the provisionally estimated areas A-2 are substantially the same as one another.

Figure 7:
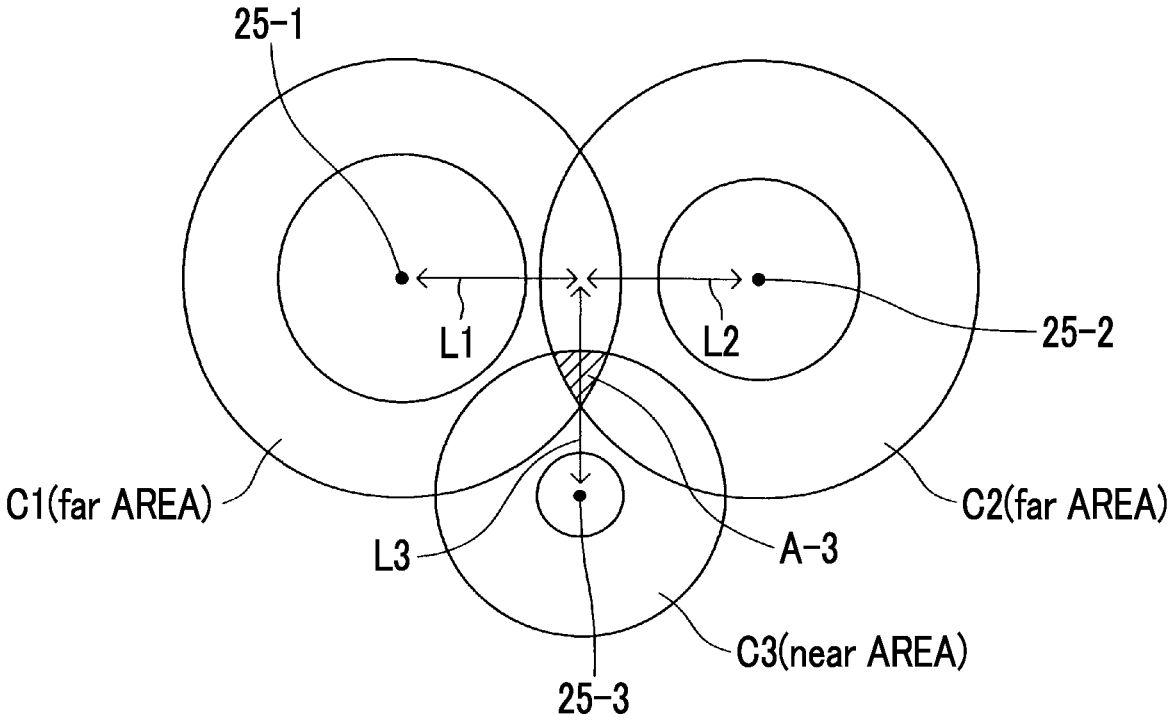
FIG. 7 is a diagram illustrating a principle of estimating a position of a beacon in an information processing device based on an estimated distance from each smartphone to the beacon calculated by three smartphones based on a radio signal transmitted by the beacon.

Further, when the information processing device 16 receives the estimated distance and the GPS information set from three smartphones 25 (25-1, 25-2, 25-3) together with the corresponding terminal ID signal in one center reception period, the information processing device 16 obtains a range estimated to include the current position of the beacon 20 based on a principle illustrated in FIG. 7. That is, the information processing device 16 obtains a provisionally estimated area A-3 in which the annular band C1, the annular band C2, and an annular band C3 (near area), which is around the smartphone 25-3 and has an outer diameter that is an upper limit value of the estimated distance L3 calculated by the smartphone 25-3 and an inner diameter which is a lower limit value thereof, overlap. The provisionally estimated area A-3 is a range which is estimated to include the current position of the beacon 20. Since the provisionally estimated area A-3 is an area based on three estimated distances, the provisionally estimated area A-3 is relatively highly likely to more accurately indicate the current position of the beacon 20 as compared with the provisionally estimated area A-2. Further, in this case, since the information processing device 16 receives a plurality of estimated distances from the three smartphone 25 in each center reception period, the information processing device 16 usually obtains six or more provisionally estimated areas A-3 in each center reception period.

Further, when the information processing device 16 receives the estimated distance and the GPS information set from four or more smartphones 25 together with the corresponding terminal ID signal in one center reception period, the information processing device 16 obtains an area corresponding to the provisionally estimated areas A-2, A-3 based on the estimated distance and the GPS information set received from the four smartphones 25. As the number of smartphones 25 that transmit the estimated distance and the GPS information set to the information processing device 16 increases, the information processing device 16 can more accurately obtain the range estimated to include the current position of the beacon 20.

Further, when at least one of the estimated distances that each smartphone 25 transmits to the information processing device 16 is a "near area" or a "far area", the provisionally estimated area becomes a large area. Particularly, when any one of the estimated distances is "far area", the provisionally estimated area is likely to be a very large area. In other words, in these cases, the provisionally estimated area is relatively highly likely to indicate an area (much) wider than one grid. Therefore, in these cases, treating the provisionally estimated area as the current position of the beacon 20 is inappropriate. Therefore, the information processing device 16 executes the following filtering process for the obtained provisionally estimated area.

In the dynamic map DM of FIG. 4, a provisionally estimated area A of one beacon 20-1-3 is illustrated. The provisionally estimated area A overlaps with a part of the river LV and a part of the building BL. However, a possibility of the signboard 35 being installed in the river LV is considered to be relatively low. Further, a possibility of the construction being performed in the building BL is considered to be relatively low. Further, the river LV and the building BL are not the respective construction scheduled sites CS1-A, CS1-B, CS2-A, CS2-B, CS4 input to the dynamic map DM. Therefore, the information processing device 16 calculates an excluded area A-e obtained by excluding an area overlapping the river LV and the buildings BL in the provisionally estimated area A from the provisionally estimated area A. The excluded area A-e is an area illustrated by hatching in FIG. 4. A filtering process in the information processing device 16 is executed in this way.

Further, the information processing device 16 calculates the estimated position A-C that is a center position of the excluded area A-e. As illustrated in FIG. 3, the information processing device 16 treats the calculated estimated position A-C as the current position of the signboard 35-1-3 (beacon 20-1-3). The information processing device 16 specifies the current positions of the beacons 20-1-1, 20-1-2, 20-1-4 to 20-1-6 and the beacon 20-2-1 using the same scheme. The information processing device 16 displays the estimated position A-C of each beacon 20 other than the beacons 20-2-2 to 20-2-5 in one grid on the display 18 in association with the beacon ID signal, as illustrated in FIG. 4.

The information processing device 16 repeatedly executes a calculation work for the estimated position A-C, for example, in the same period as the center reception period. Further, the information processing device 16 records each calculated estimated position A-C in the RAM in time series in the same period as the center reception period. The display 18 repeatedly displays each estimated position A-C of the signboard 35 (the beacon 20), for example, in the same period as the center reception period, as illustrated in FIG. 4. Accordingly, when the signboard 35 (the beacon 20) moves, the position of the signboard 35 (the beacon 20) on the dynamic map DM is changed.

Further, the information processing device 16 displays the position based on the GPS position information of the smartphone 25 corresponding to the received terminal ID signal to be superimposed on the map image of the dynamic map DM, as illustrated in FIG. 4. That is, the position of the corresponding smartphone 25 is displayed to be superimposed on the position indicated by the GPS position information in the map image.

An owner's name of each smartphone 25 (or a name of constructor) and information on the corresponding vehicle 50 or the like are recorded in association with the terminal ID signal on the ROM of the information processing device 16 of the data center 15. Therefore, in FIG. 4, the positions of the respective vehicles 50CS1, 50CS2, 50CS4, 50A, 50B, 50C, 50D, 50E moving with the respective smartphones 25 are displayed with the positions of the respective smartphones 25.

Further, actual positions of the respective vehicles 50CS1, 50CS2, 50CS4, 50A, 50B, 50C, 50D, 50E may be changed over time. Since the information processing device 16 receives the GPS position information along with the terminal ID signals from the respective smartphones 25 in time series, the positions of the respective vehicles 50CS1, 50CS2, 50CS4, 50A, 50B, 50C, 50D, 50E displayed to be superimposed on the map image of the dynamic map DM are changed when the respective vehicles 50CS1, 50CS2, 50CS4, 50A, 50B, 50C, 50D, 50E move over time.

Further, the information processing device 16 specifies respective areas of the construction sites CS1-A-R, CS1-B-R, CS2-A-R, CS2-B-R, CS4-R that are places at which construction is estimated to be currently performed, based on information on the estimated position A-C of each beacon 20 other than the beacons 20-2-2 to 20-2-5 and the GPS position information of the respective vehicles 50CS1, 50CS2, 50CS4 (the smartphones 25), and displays information on the respective specifies areas to be superimposed on the map image of the dynamic map DM. Specifically, the information processing device 16 displays the respective areas of the construction sites CS1-A-R, CS1-B-R, CS2-A-R, CS2-B-R, CS4-R to be superimposed on the map image of the dynamic map DM using arrows, as illustrated in FIG. 3. In the actual dynamic map DM, the arrows are displayed along with the corresponding beacons 20 (signboard 35) and the corresponding smartphones 25 (the vehicles 50).

As illustrated in FIG. 4, three signboards 35-1-1 to 35-1-3 (beacons 20-1-1 to 20-1-3) are installed on the sidewalk R1*sw* adjacent to the lane R1-1-A of the target road R1-1. Then, the information processing device 16 estimates areas in which respective circular areas (with a radius of several m to tens of m) around the respective beacons 20-1-1 to 20-1-3 and the sidewalk R1*sw* overlap to be the construction site CS1-A-R. In the embodiment, adjacent circles of the respective beacons 20-1-1 to 20-1-3 overlap each other. Therefore, the information processing device 16 estimates a part of the sidewalk R1*sw*, which is the area located between the beacon 20-1-1 and the beacon 20-1-3, to be the construction site CS1-A-R. Further, when the vehicle 50CS1 on the lane R1-1-A is parked for a predetermined time (a first predetermined time such as one hour) or more (in a state in which the vehicle speed is zero) (that is, when the position of the smartphone 25CS1 is not changed for the first predetermined time or more), the information processing device 16 estimates an area in which a circular area (with a radius of several m to tens of m) around the vehicle 50CS1 and the lane R1-1-A overlap to be the construction site CS1-A-R. On the other hand, when the position of the continuously temporarily stopped vehicle 50CS1 is changed within a time shorter than the first predetermined time, the information processing device 16 estimates that the construction is not actually performed at the stop position of the vehicle 50CS1. Therefore, the information processing device 16 displays an arrow indicating an area of the construction site CS1-A-R to correspond to each of the signboards 35-1-1 to 35-1-3 (the beacons 20-1-1 to 20-1-3) and the vehicle 50CS1 (the smartphone 25CS1) in the dynamic map DM, as illustrated in FIG. 3.

The three signboards 35-1-4 to 35-1-6 (beacons 20-1-4 to 20-1-6) are installed on the lane R1-2-A of the target road R1-2. Then, the information processing device 16 estimates that an area in which an area of each of circles (with a radius of several m to tens of m) around the respective beacons 20-1-4 to 20-1-6 and the lane R1-2-A overlap is the construction site CS1-B-R. In the embodiment, adjacent circles of the respective beacons 20-1-4 to 20-1-6 overlap. Therefore, the information processing device 16 estimates that an area that is a part of the lane R1-2-A and is located between the beacon 20-1-4 and the beacon 20-1-6 is the construction site CS1-B-R. Therefore, the information processing device 16 displays an arrow indicating the area of the construction site CS1-B-R in the dynamic map DM to correspond to each of the signboards 35-1-4 to 35-1-6 (the beacons 20-1-4 to 20-1-6), as illustrated in FIG. 3.

When each vehicle 50CS2 is parked for a predetermined time (the first predetermined time) or more on the lane R2-A-L of the target road R2 (in a state in which the vehicle speed is zero)(that is, when the position of the smartphone 25CS2 is not changed for the first predetermined time or more), the information processing device 16 estimates that an area in which a circular area (with a radius of several m to tens of m) around each smartphone 25CS and the lane R2-A-L overlap is the construction site CS2-A-R. In the embodiment, circles of the adjacent smartphones 25CS2 overlap. Therefore, the information processing device 16 estimates that an area that is a part of the lane R2-A-L and is located between the two smartphones 25CS2 placed inside the two vehicles 50CS2 located at both ends is the construction site CS2-A-R. Therefore, the information processing device 16 displays an arrow indicating the area of the construction site CS2-A-R to correspond to each of the vehicle 50CS2 (the smartphone 25CS2) in the dynamic map DM, as illustrated in FIG. 3.

The five signboards 35-2-1 to 35-2-5 (beacons 20-2-1 to 20-2-5) are installed on the sidewalk R2*sw* adjacent to the lane R2-B. However, the main switch SW is in the ON state solely in the beacon 20-2-1 among the beacons 20-2-1 to 20-2-5. Therefore, the information processing device 16 estimates an area in which a circular area (with a radius of several m to tens of m) around the beacon 20-2-1 and the sidewalk R2*sw* overlap to be the construction site CS2-B-R. Therefore, the information processing device 16 displays an arrow indicating the area of the construction site CS2-B-R to correspond to the signboard 35-2-1 (the beacon 20-2-1) on the dynamic map DM, as illustrated in FIG. 3. Further, as illustrated by a phantom line in FIG. 4, signboards 35-2-2 to 35-2-5 (beacons 20-2-2 to 20-2-5) are actually installed on the sidewalk R2*sw*. However, the switches SW of the beacons 20-2-2 to 20-2-5 are in the OFF state. Therefore, the information processing device 16 does not recognize the beacons 20-2-2 to 20-2-5. Therefore, the information processing device 16 does not actually display the signboard 35-2-2 to 35-2-5 (the beacons 20-2-2 to 20-2-5) in the dynamic map DM.

When each vehicle 50CS4 is parked for a predetermined time (the first predetermined time) or more on the target road R4 (in a state in which the vehicle speed is zero)(that is, when the position of the smartphone 25CS4 is not changed for the first predetermined time or more), the information processing device 16 estimates an area in which a circular area (with a radius of several m to tens of m) around the smartphone 25CS4 and the target road R4 overlap to be the construction site CS4-R. Therefore, the information processing device 16 displays the arrow indicating the area of the construction site CS4-R to correspond to the vehicle 50CS4 (the smartphone 25CS4) on the dynamic map DM, as illustrated in FIG. 3.

Further, the information processing device 16 estimates the current situation of the respective target roads R1, R2, R3, R4 at predetermined time intervals (for example, in every one second) based on the GPS position information of the respective vehicle 50A, 50B, 50C, 50D, 50E (smartphones 25), and displays information on the estimated current situation to be superimposed on the map image of the dynamic map DM. Specifically, the information processing device 16 displays the information in the current situation display portion DM-C (not illustrated in FIGS. 3 and 4) of the road formed in a part of the dynamic map DM (map image 31D), as illustrated in FIG. 5.

Since the vehicle 50CS1 is parked on the lane R1-1-A, solely the lane R1-1-B cannot pass on the target road R1-1. When the vehicle 50 (the smartphone 25) does not travel on the lane R1-1-A over a predetermined time (a second predetermined time. For example, 30 minutes) or more and travels on the lane R1-1-B, the information processing device 16 determines that the target road R1-1 is under one-way traffic regulation at the present time. Therefore, an indication that the target road R1-1 is under the one-way traffic regulation at the present time is displayed in the current situation display portion DM-C of the road of the dynamic map DM.

Since the three signboards 35-1-4 to 35-1-6 are installed in the lane R1-2-A, the target road R1-2 can pass solely on the lane R1-2-B. When a situation in which all vehicles (for example, the vehicle 50B) travel on the lane R1-2-B from the left to the right over a predetermined time (a third predetermined time. For example, 30 minutes) or more and a situation in which all vehicles (for example, the vehicle 50C indicated by a phantom line) travel on the lane R1-2-B from the right to the left over a predetermined time (a fourth predetermined time. For example, 30 minutes) or more continue alternately, the information processing device 16 determines that the target road R1-2 is under one-sided alternate traffic regulation at the present time. Therefore, an indication that the target road R1-2 is under the one-sided alternate traffic regulation at the present time is displayed in the current situation display portion DM-C of the road.

Since the vehicle 50CS4 is parked on the target road R4 that is a one-way traffic road, the vehicle cannot pass on the target road R4 at the present time. When the vehicle 50 (the smartphone 25) does not travel on the target road R4 over a predetermined time (a fifth predetermined time. For example, 30 minutes) or more, the information processing device 16 determines that the target road R4 is under a traffic stop regulation at the present time. Therefore, an indication that the target road R4 is under the traffic stop regulation at the present time is displayed in the current situation display portion DM-C of the road.

Since the five vehicles 50CS2 are parked on the left lane R2-A-L of the lane R2-A, the vehicle cannot pass on the left lane R2-A-L at the present time. When the vehicle 50 (the smartphone 25) does not travel on the left lane R2-A-L over a predetermined time (a sixth predetermined time; for example 30 minutes) or more and travels on the right lane R2-A-R, the information processing device 16 determines that the lane R2-A of the target road R2 is under the lane regulations at the present time. Therefore, an indication that the lane R2-A is under the lane regulation at the present time is displayed in the current situation display portion DM-C of the road.

A part of the sidewalk R2*sw* along the river LV is a construction site CS2-B-R at the present time. However, vehicles can travel on the lane R2-B (with two lanes) adjacent to the sidewalk R2*sw*, as normal. That is, the lane R2-B is not under any traffic regulation at the present time.

Further, a plurality of traffic jam determination areas corresponding to partial areas of the respective target roads R1, R2, R3, R4 is set in the dynamic map DM. For example, as illustrated in FIG. 3, traffic jam determination areas TJA-A, TJA-B are set in a part of the right lane R2-A-R of the target road R2 and the right lane R2-B-R of the lane R2-B in the dynamic map DM. The information processing device 16 calculates, for each smartphone 25, an average value (average speed) of a movement speed of all the smartphones 25 (the vehicles 50) passing through the respective traffic jam determination areas TJA-A, TJA-B based on the position change amount (movement distance) on the dynamic map DM per unit time of the smartphone 25. Further, the information processing device 16 calculates an average speed of all the vehicles 50 passing through the traffic jam determination areas TJA-A, TJA-B for a predetermined time (a seventh predetermined time. For example, 10 minutes), and calculates an average value of the average speed of all the vehicles 50. The information processing device 16 compares the calculated average value of the average speed with the traffic jam determination speed threshold value recorded on the ROM of the information processing device 16 in advance.

Since the lane R2-A is under the lane regulation, the average speed of the vehicle 50 traveling on the right lane R2-A-R has a smaller value than a normal value. Therefore, an average value of the average speed of all the vehicles 50 passing through the traffic jam determination area TJA-A is equal to or smaller than the traffic jam determination speed threshold value. Then, the information processing device 16 determines that the traffic jam is caused in the traffic jam determination area TJA-A at the present time, and performs a display showing that "The traffic jam is being generated in the lane R2-A" in the current situation display portion DM-C of the road, as illustrated in FIG. 5. On the other hand, since the lane R2-B (right lane R2-B-R) is not under any traffic restriction, the average speed of the vehicles 50 traveling on the right lane R2-B-R does not have a smaller value than the normal value. Therefore, the average value of the average speed of all the vehicles 50 passing through the traffic jam determination area TJA-B is equal to or greater than the traffic jam determination speed threshold value. Accordingly, the information processing device 16 determines that the traffic jam is not generated in the traffic jam determination area TJA-B at the present time. In this case, the information processing device 16 does not perform a display showing that the traffic jam is caused in the lane R2-B in the current situation display portion DM-C of the road.

Further, the information processing device 16 repeatedly transmits the position information of the beacon 20 (the signboard 35), the position information (GPS position information) of the vehicle 50 (the smartphone 25), information on the respective construction scheduled sites CS1-A, CS1-B, CS2-A, CS2-B, CS4, information on the respective construction sites CS1-A-R, CS1-B-R, CS2-A-R, CS2-B-R, CS4-R, and current traffic regulation information of the respective target roads R1, R2, R3, R4 to the respective smartphones 25 that read the target road information acquisition application, at predetermined time intervals. As a result, the same image as the dynamic map DM in FIGS. 3 and 4 and the current situation display portion DM-C of the road in FIG. 5 is displayed in the map image 31D of the display 31 of each smartphone 25. A transmission period of at least portion of information from the information processing device 16 to the smartphone 25 can be the same as a display period of each piece of information in the dynamic map DM in the information processing device 16. That is, for example, the position information of the beacon 20 (the signboard 35) and the traffic control information may be transmitted from the information processing device 16 to the smartphone 25 at every second.

Therefore, a person who has viewed the map image 31D of the smartphone 25 can reliably recognize the area in which the construction is actually performed at the present time. Further, the person who has viewed the map image 31D of the smartphone 25 can recognize that the area in which the construction is actually performed at the present time in the construction scheduled site CS2-B is solely the construction CS2-B-R. In other words, the person can recognize that the construction is not actually performed in the area corresponding to the signboard 35-2-2 to 35-2-5.

Further, the person who has viewed the map image 31D of the smartphone 25 can reliably recognize a current situation of the respective target roads R1, R2, R3, R4 at the present time. In other words, the person who has viewed the map image 31D of the smartphone 25 can traffic regulations and a situation related to traffic jam of the respective target roads R1, R2, R3, R4 at the present time.

A result of estimating the respective construction sites CS1-A-R, CS1-B-R, CS2-A-R, CS2-B-R, CS4-R and a result of estimating of the current situation of the respective target roads R1, R2, R3, R4 in the information processing device 16 are changed according to a change in the situation of the beacon 20, the smartphone 25, the signboard 35, and the vehicles 50CS1, 50CS2, 50CS3, 50CS4. For example, when a construction worker at the construction scheduled site CS2-B (the sidewalk R2*sw*) turns OFF the main switches SW of all of the beacons 20-2-1 to 20-2-5 or the construction worker removes all signboards 35-2-1 to 35-2-5 from the construction scheduled site CS2-B, the information processing device 16 estimates that there is no construction site CS2-B-R on the sidewalk R2*sw*, and does not perform a display regarding the construction site CS2-B-R in the dynamic map DM. Therefore, a person who has viewed the map image 31D can recognize that the construction is not actually performed in the construction scheduled site CS2-B (the sidewalk R2*sw*). Further, for example, when all the vehicles 50CS2 (and the smartphones 25CS2) move from the lane R2-A-L to another place (for example, a road that is not displayed in the dynamic map DM), the information processing device 16 estimates that there is no construction site CS2-A-R in the lane R2-A-L. That is, the information processing device 16 does not display an arrow indicating the construction site CS2-A-R in the dynamic map DM (and the map image 31D). Further, in this case, a vehicle (not illustrated) moving together with the smartphone 25 can travel on the lane R2-A-L. Therefore, in this case, the information processing device 16 estimates that the lane R2A (R2-A-L) is not under a traffic regulation (the lane regulation is released) at present time based on the GPS position information of the vehicle (smartphone 25), and deletes a display indicating that the lane R2-A is under a lane regulation from the dynamic map DM. Therefore, the person who has viewed the map image 31D can recognize that the construction is not performed in the lane R2-A-L, and the lane R2-A is not under the lane regulation.

Subsequently, a detailed operation that the beacon 20, the ECU 27 of the smartphone 25, and the information processing device 16 of the data center 15 execute will be described while using flowcharts of FIGS. 8 to 16.

Figure 8:
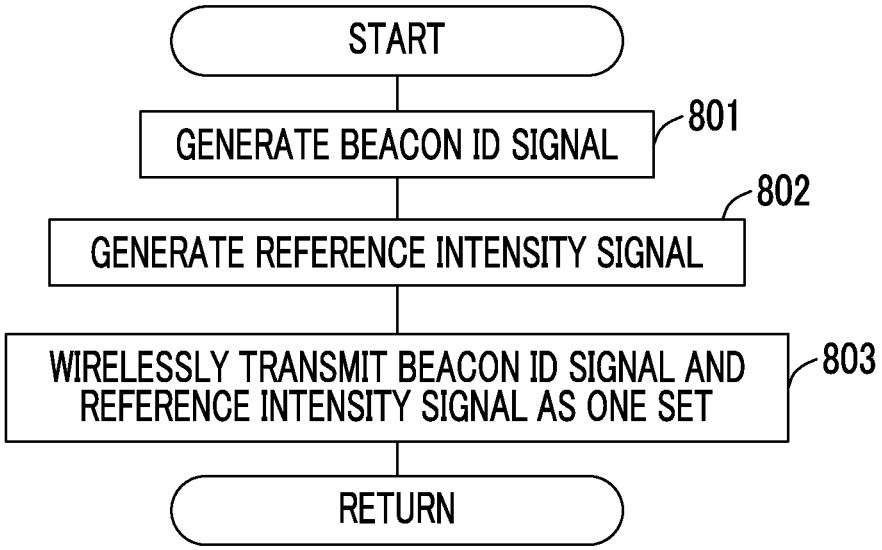
FIG. 8 is a flowchart illustrating a process that is executed by an IC chip of a beacon.

The IC chip 22 of the beacon 20 repeatedly executes the routine shown in the flowchart in FIG. 8 each time a predetermined time interval elapses.

The IC chip 22 first generates the beacon ID signal in step 801. Further, the IC chip 22 proceeds to step 802 and generates the reference intensity signal. Further, the IC chip 22 proceeds to step 803 and transmits the beacon ID signal and the reference intensity signal as a set together with the radio signal (radio waves) from the antenna 24 to the outside. The IC chip 22 ending the process of step 803 temporarily ends the routine.

Figure 9:
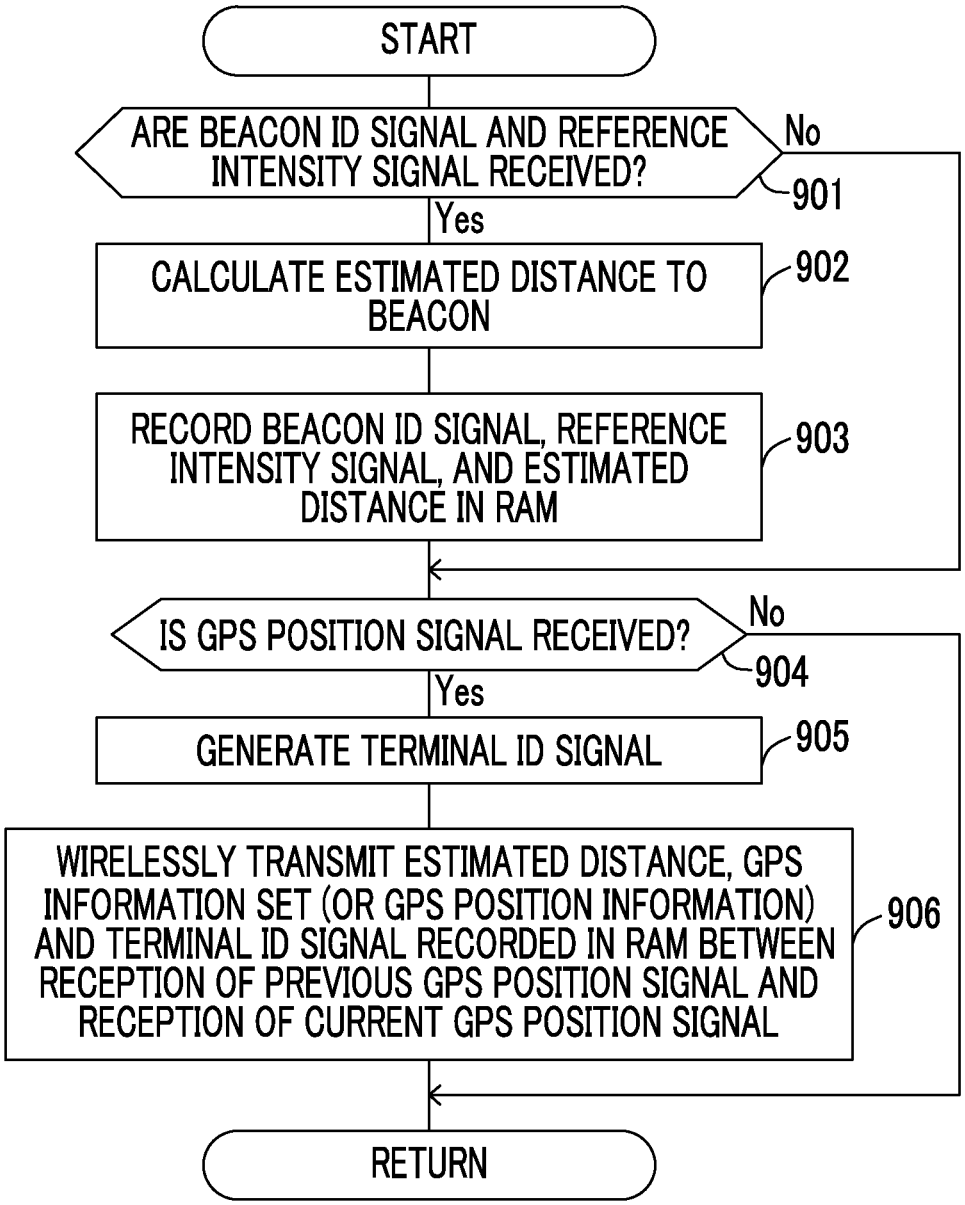
FIG. 9 is a flowchart illustrating a process that is executed by an ECU of a smartphone.

The ECU 27 of the smartphone 25 repeatedly executes a process of a flowchart illustrated in FIG. 9 each time a predetermined time elapses.

The ECU 27 determines whether or not the wireless communication antenna 29 has received the beacon ID signal and the reference intensity signal from the beacon 20 in step 901.

When ECU 27 determines Yes in step 901, the ECU 27 proceeds to step 902, and calculates an estimated distance up to the beacon 20 corresponding to the beacon ID signal received from the smartphone 25 based on the actual intensity of the radio signal and the reference intensity signal that the antenna 24 has received from the beacon 20.

The ECU 27 ending the process of step 902 proceeds to step 903, and records the beacon ID signal, the reference intensity signal, and the estimated distance in the RAM together.

The ECU 27 ending the process of step 903 proceeds to step 904, and determines whether or not the GPS reception antenna 30 receives the GPS position signal. When the ECU 27 determines No in step 904, the ECU 27 temporarily ends the present routine.

When the ECU 27 determines Yes in step 904, the ECU 27 proceeds to step 905, and generates a terminal ID signal.

The ECU 27 ending the process of step 905 proceeds to step 906 and controls the wireless communication antenna 29. As a result, the estimated distance and the GPS information set (or the GPS position information), and the terminal ID signal recorded (accumulated) on the RAM from the reception of the previous GPS position signal to the reception of the GPS position signal in step 904 of the present routine are transmitted from the wireless communication antenna 29. The ECU 27 ending the process of step 906 temporarily ends the present routine.

Figure 10:
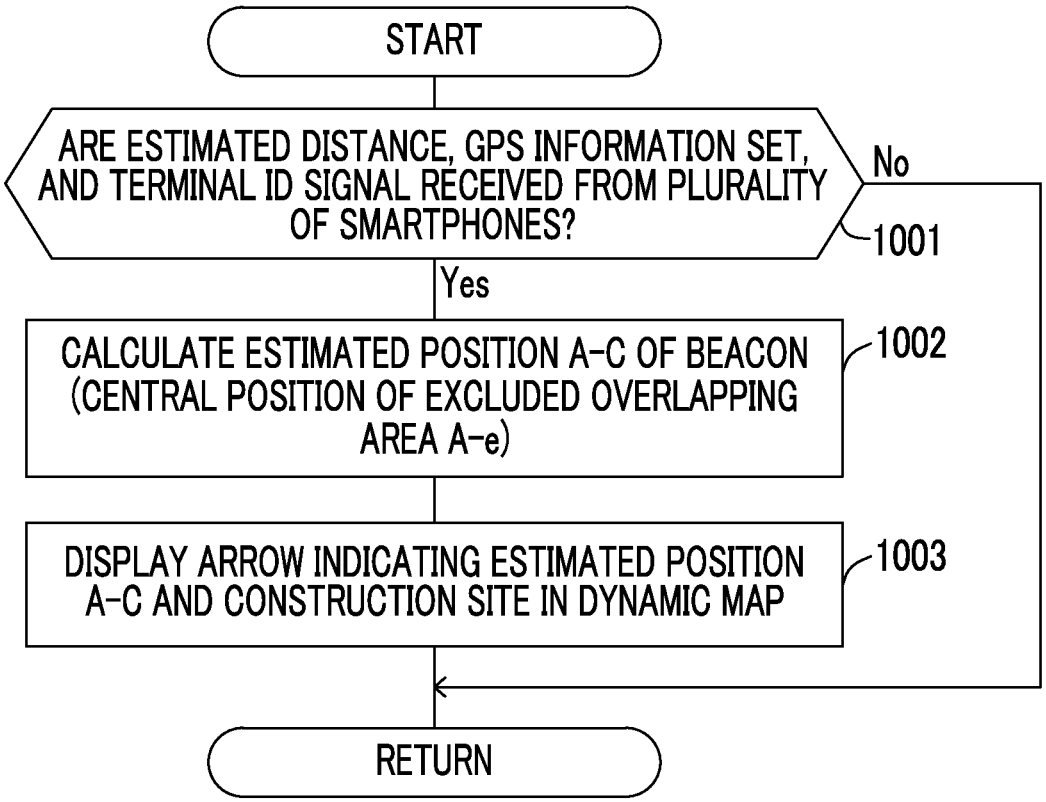
FIG. 10 is a flowchart illustrating a process that is executed by the information processing device.

The information processing device 16 of the data center 15 repeatedly executes a process of a flowchart illustrated in FIG. 10 each time a predetermined time elapses.

The information processing device 16 determines whether or not the estimated distance and the GPS information set, and the terminal ID signal have been received from the plurality of smartphones 25 in step 1001.

When the information processing device 16 determines Yes in step 1001, the information processing device 16 proceeds to step 1002 and obtains the estimated position A-C of the beacon 20 according to the above-described procedure.

The information processing device 16 ending the process of step 1002 proceeds to step 1003 and displays the estimated position A-C in the dynamic map DM on the display 18. Further, the information processing device 16 displays an arrow indicating the construction site (CS1-A-R, CS1-B-R, CS2-B-R) in the dynamic map DM.

When the information processing device 16 determines No in step 1001 or when the information processing device 16 ends the process of step 1003, the information processing device 16 temporarily ends the present routine.

Figure 11:
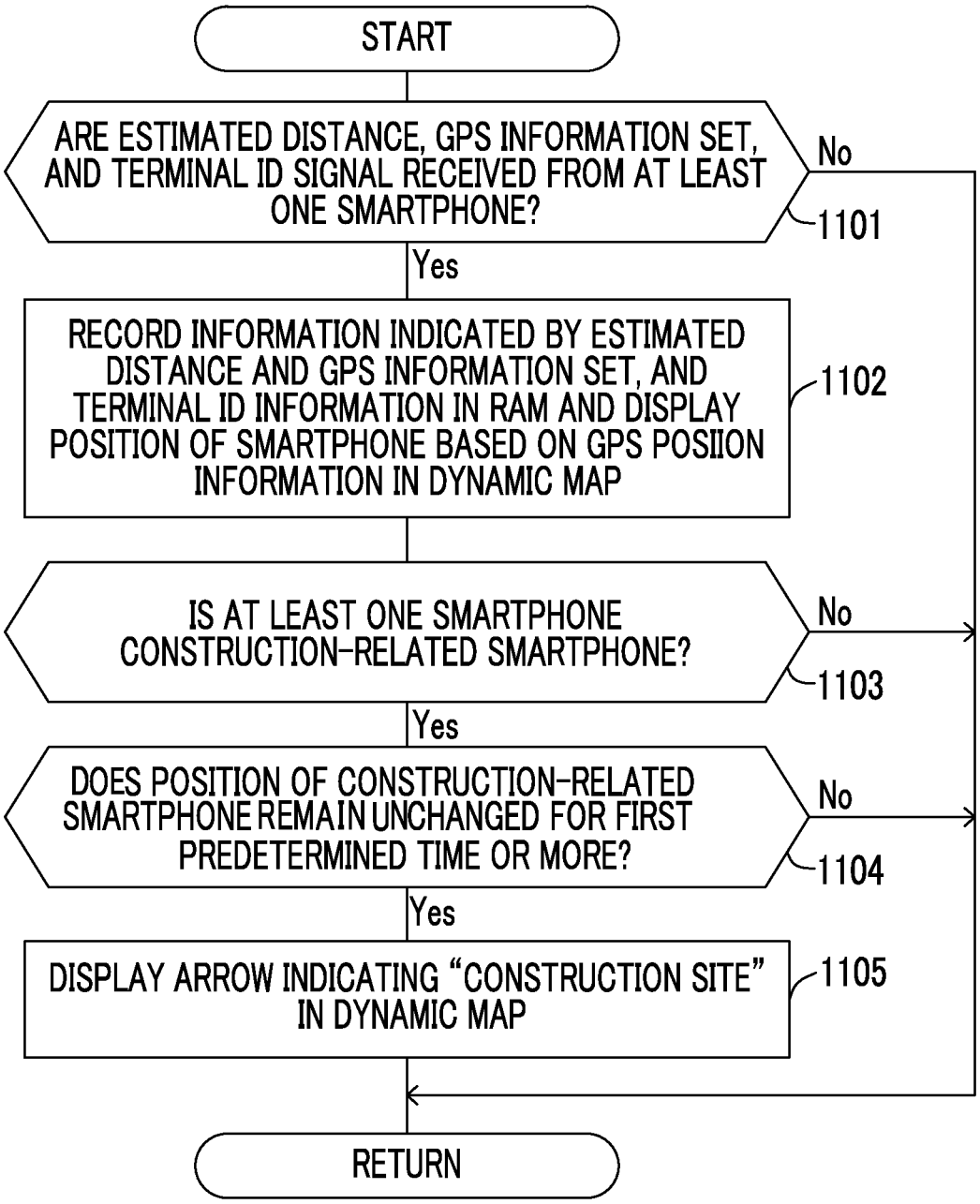
FIG. 11 is a flowchart illustrating a process that is executed by the information processing device.

The information processing device 16 of the data center 15 repeatedly executes a process of a flowchart illustrated in FIG. 11 each time a predetermined time elapses.

The information processing device 16 determines whether or not the estimated distance, the GPS information set, and the terminal ID signal have been received from at least one of the smartphones 25 in step 1101. When the information processing device 16 determines No in step 1101, the information processing device 16 temporarily ends the present routine.

When the information processing device 16 determines Yes in step 1101, the information processing device 16 proceeds to step 1102, and records the estimated distance, the GPS information set, and the terminal ID signal in the RAM. Further, the information processing device 16 displays the position of the smartphone 25 based on the GPS position information on the dynamic map DM.

The information processing device 16 ending the process of step 1102 proceeds to step 1103, and determines whether or not at least one smartphone 25 that has received the estimated distance, the GPS information set, and the terminal ID signal is the smartphones 25CS1, 25CS2, 25CS4 of the constructors. Hereinafter, the smartphone 25CS1, 25CS2, 25CS4 may be referred to as a "construction-related smartphones". When the information processing device 16 determines No in step 1103, the information processing device 16 temporarily ends the present routine.

When the information processing device 16 determines Yes in step 1103, the information processing device 16 proceeds to step 1104 and determines whether the position of the construction-related smartphones 25CS1, 25CS2, 25CS4 remain unchanged for a first predetermined time or more. When the information processing device 16 determines No in step 1104, the information processing device 16 temporarily ends the present routine.

When the information processing device 16 determines Yes in step 1104, the information processing device 16 proceeds to step 1105, and displays an arrow indicating the construction sites (CS1-A-R, CS1-B-R, CS2-B-R) to correspond to the positions of the construction-related smartphones 25CS1, 25CS2, 25CS4 determined to be Yes in step 1104 in the dynamic map DM. The information processing device 16 ending the process of step 1105 temporarily ends the present routine.

Figure 12:
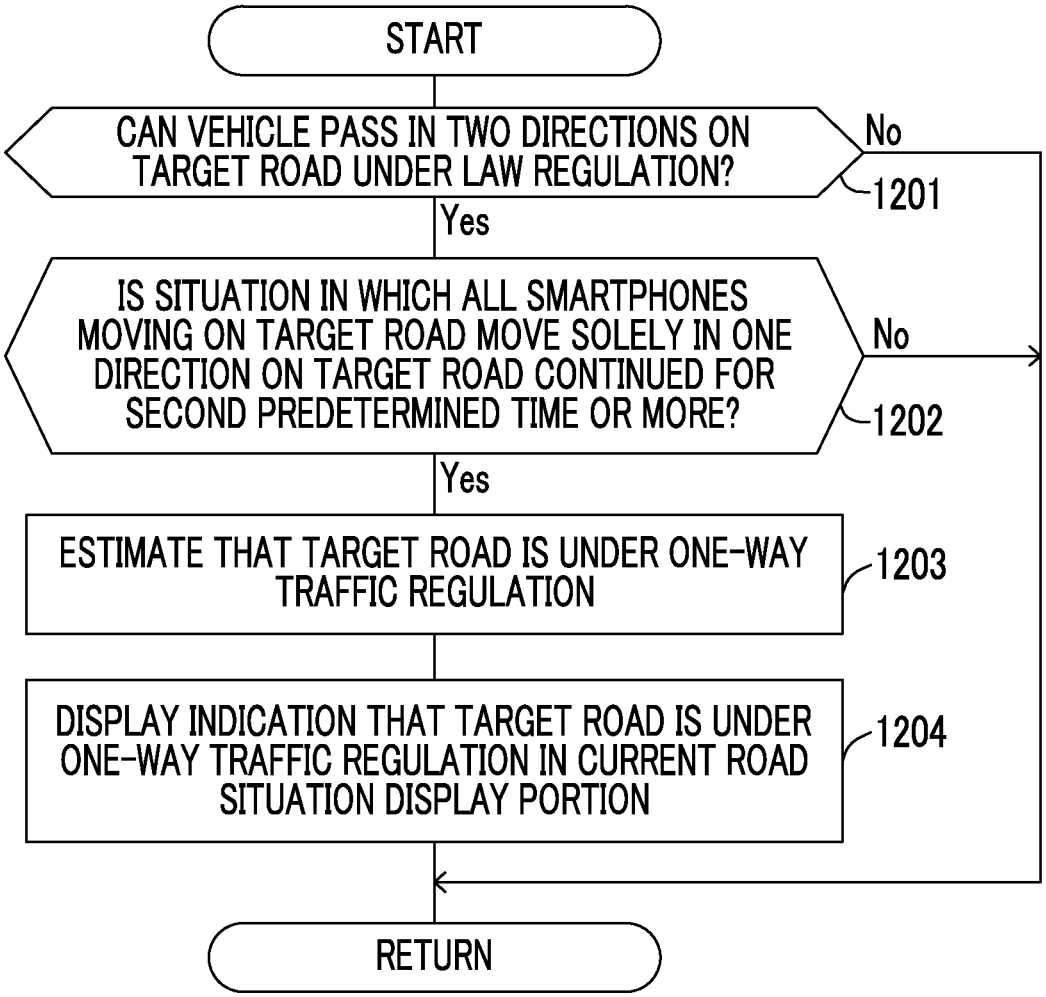
FIG. 12 is a flowchart illustrating a process that is executed by the information processing device.

The information processing device 16 of the data center 15 repeatedly executes a process of a flowchart illustrated in FIG. 12 each time a predetermined time elapses.

The information processing device 16 performs a process of step 1201 on the respective target roads R1, R2, R3, R4. For example, when the information processing device 16 has performed the process of step 1201 on the target roads R1, R2, R3, the information processing device 16 determines Yes in step 1201 and proceeds to step 1202. On the other hand, when the information processing device 16 has performed the process of step 1201 on the target road R4, the information processing device 16 determines No in step 1201 and temporarily ends the present routine.

The information processing device proceeding to step 1202 16 determines whether or not a situation in which all of the smartphones 25 moving on the target road move solely in one direction on the target road continues for a second predetermined time or more. When the information processing device 16 determines No in step 1202, the information processing device 16 temporarily ends the present routine.

When the information processing device 16 determines Yes in step 1202, the information processing device 16 proceeds to step 1203, and estimates that the target road (for example, the lane R1-1 of the target road R1) is under a one-way traffic regulation.

The information processing device 16 which has ended the process in step 1203 proceeds to step 1204, and displays an indication that the target road is under a one-way traffic regulation in the current situation display portion DM-C of the road. The information processing device 16 ending the process of step 1204 temporarily ends the present routine.

Figure 13:
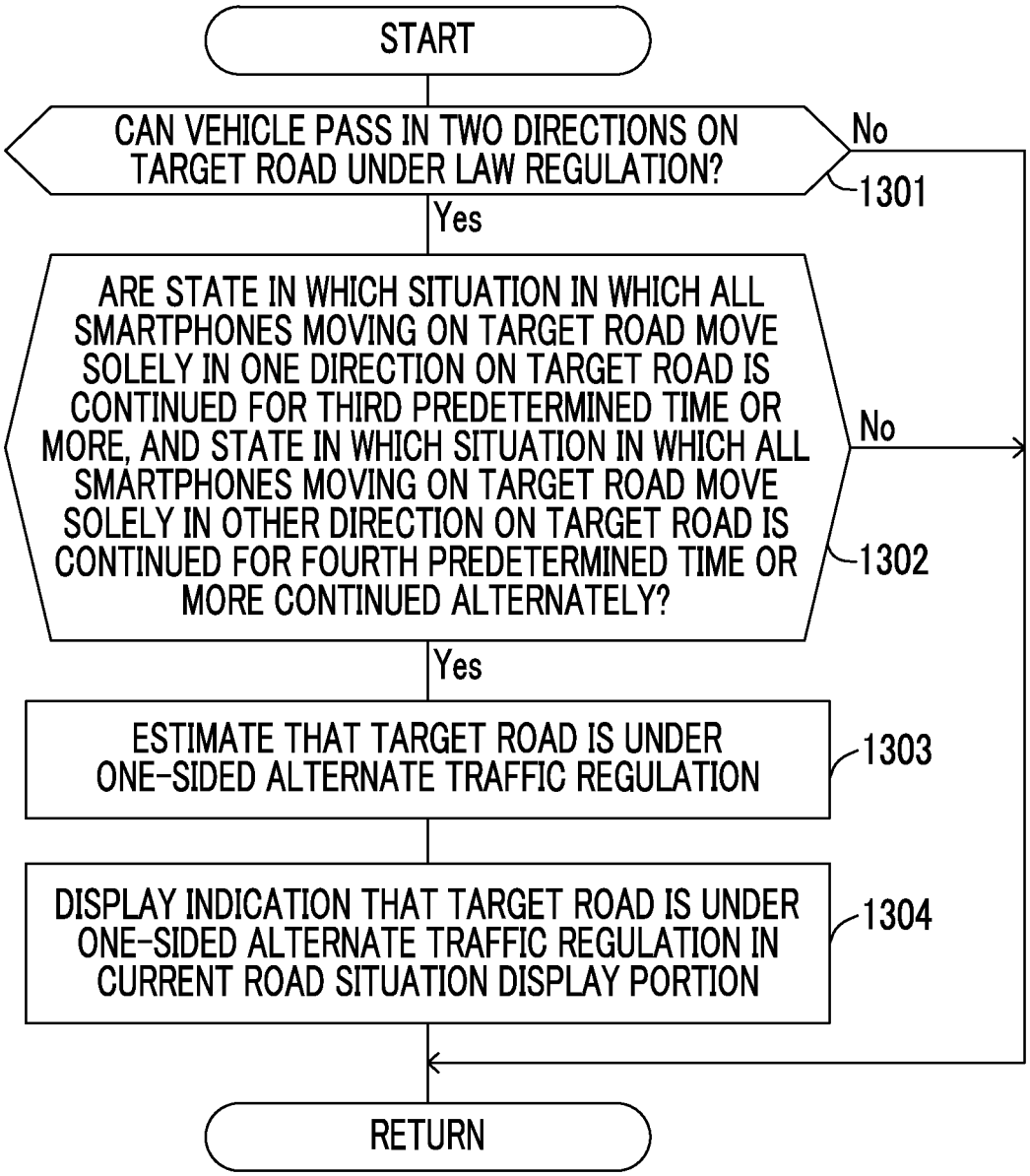
FIG. 13 is a flowchart illustrating a process that is executed by the information processing device.

The information processing device 16 of the data center 15 repeatedly executes a process of a flowchart illustrated in FIG. 13 each time a predetermined time elapses.

First, the information processing device 16 performs a process of step 1301. The process is the same as step 1201.

The information processing device 16 determining Yes in step 1301 proceeds to step 1302, and determines whether or not a state in which all the smartphones 25 moving on the target road move solely in one direction on the target road continues for a third predetermined time or more and a state in which all the smartphones 25 moving on the target road move solely in the other direction on the target road continues for a fourth predetermined time or more alternately continue. When the information processing device 16 determines No in step 1302, the information processing device 16 temporarily ends the present routine.

When the information processing device 16 determines Yes in step 1302, the information processing device 16 proceeds to step 1303 and estimates that the target road (for example, the lane R1-2-B of the target road R1-2) is under a one-sided alternate traffic regulation.

The information processing device 16 ending the process of step 1303 proceeds to step 1304 and displays an indication that the target road is under the one-sided alternate traffic restriction in the current situation display portion DM-C of the road. The information processing device 16 ending the process of step 1304 temporarily ends the present routine.

Figure 14:
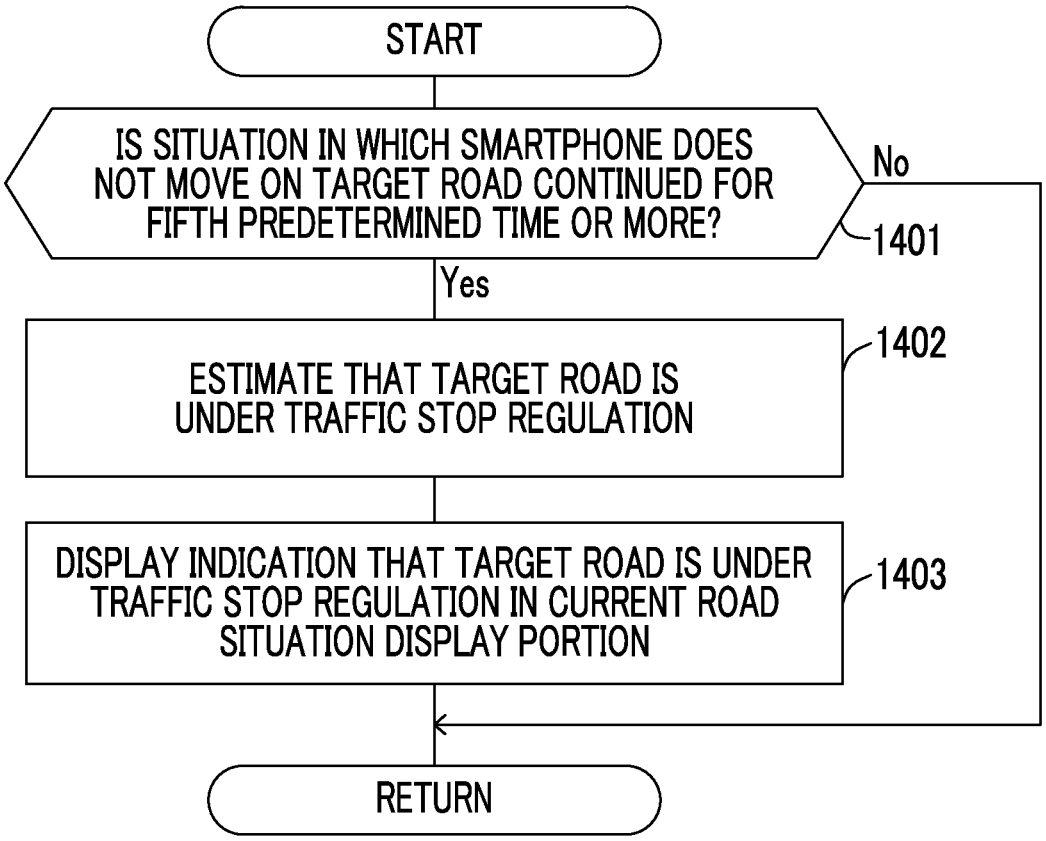
FIG. 14 is a flowchart illustrating a process that is executed by the information processing device.

The information processing device 16 of the data center 15 repeatedly executes a process of a flowchart illustrated in FIG. 14 each time a predetermined time elapses.

First, the information processing device 16 performs the process of step 1401 on the respective target roads R1, R2, R3, R4. That is, the information processing device 16 determines whether or not a situation in which the smartphone 25 does not move on the target road continues for the fifth predetermined time or more, with respect to the target roads R1, R2, R3, R4. When the information processing device 16 determines No in step 1401, the information processing device 16 temporarily ends the present routine.

When the information processing device 16 determines Yes in step 1401, the information processing device 16 proceeds to step 1402 and estimates that the target road (for example, the target road R4) is under a traffic stop regulation.

The information processing device 16 ending the process of step 1402 proceeds to step 1403 and displays an indication that the target road is under the traffic stop restriction in the current situation display portion DM-C of the road. The information processing device 16 ending the process of step 1403 temporarily ends the present routine.

Figure 15:
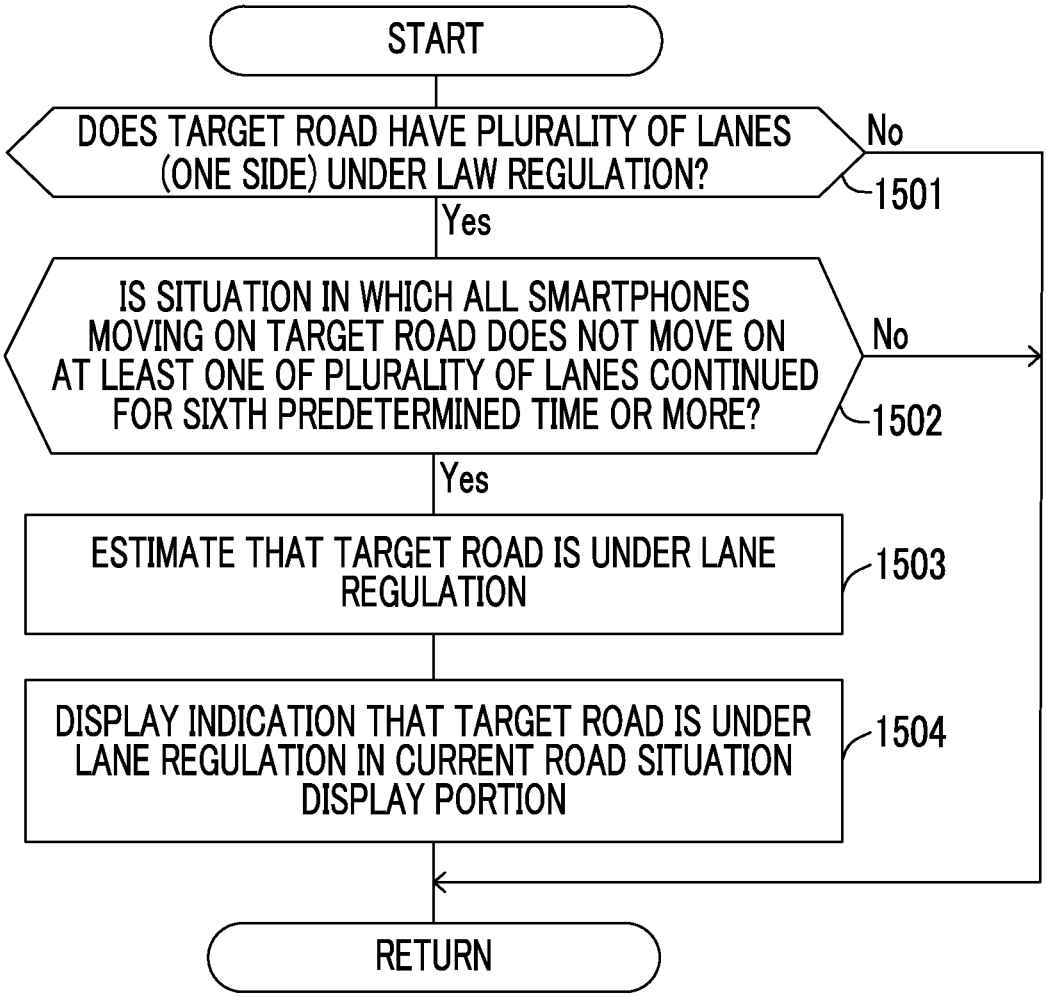
FIG. 15 is a flowchart illustrating a process that is executed by the information processing device.

The information processing device 16 of the data center 15 repeatedly executes a process of a flowchart illustrated in FIG. 15 each time a predetermined time elapses.

The information processing device 16 performs a process of step 1501 on the respective target roads R1, R2, R3, R4. For example, when the information processing device 16 has performed the process of step 1501 on the target road R2, the information processing device 16 determines Yes in step 1501 and proceeds to step 1502. On the other hand, when the information processing device 16 has performed the process of step 1501 for the target road R1, R3, R4, the information processing device 16 determinates No in step 1501 and temporarily ends the present routine.

The information processing device 16 proceeding to step 1502 determines whether or not a situation in which all the smartphone 25 moving on the target road do not move on at least one of the plurality of lanes of the target road continues for a sixth predetermined time or more. When the information processing device 16 determines No in step 1502, the information processing device 16 temporarily ends the present routine.

When the information processing device 16 determines Yes in step 1502, the information processing device 16 proceeds to step 1503 and estimates that the target road (for example, the lane R2-A of the target road R2) is under a lane regulation.

The information processing device 16 ending the process of step 1503 proceeds to step 1504 and displays an indication that the target road is under the lane regulation in the current situation display portion DM-C of the road. The information processing device 16 ending the process of step 1504 temporarily ends the present routine.

Figure 16:
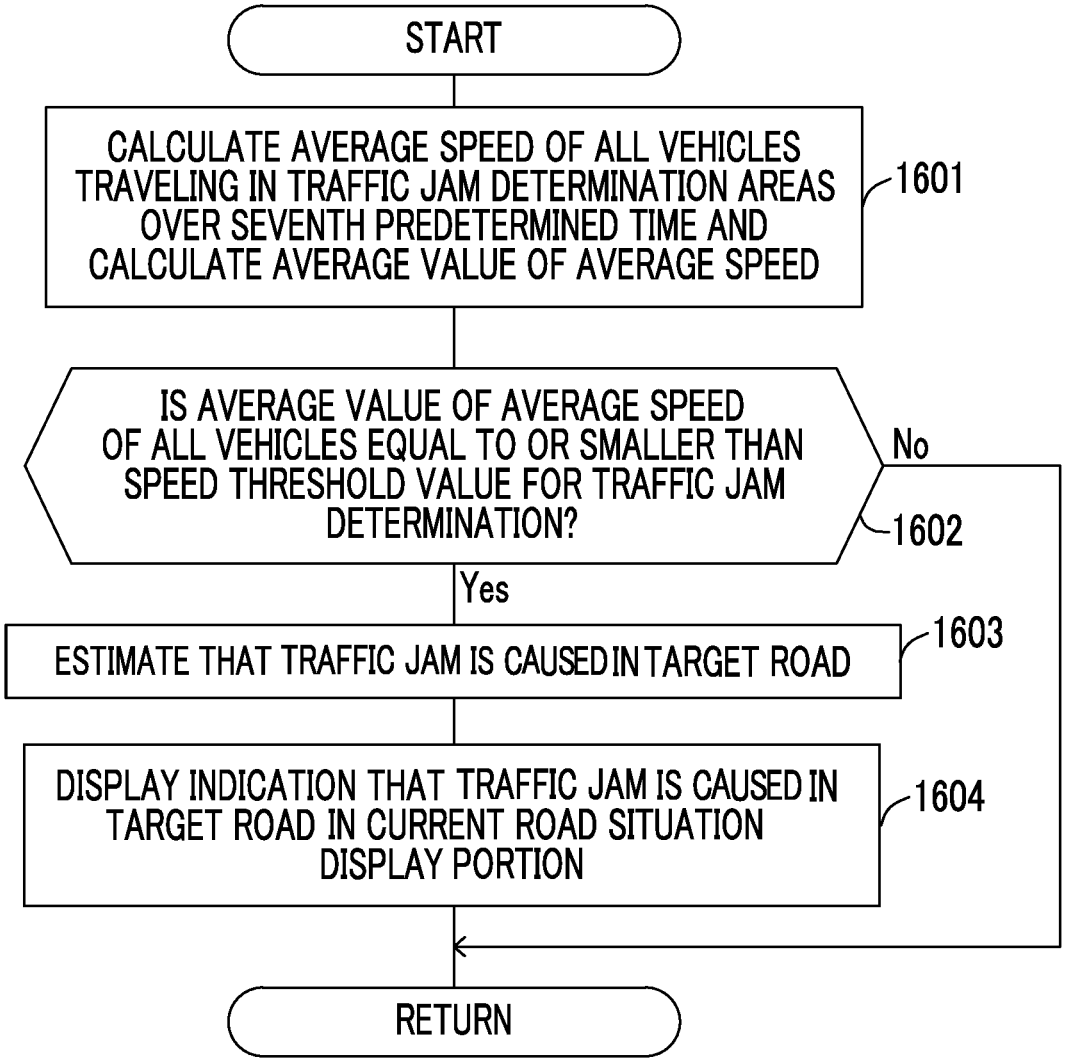
FIG. 16 is a flowchart illustrating a process that is executed by the information processing device.

The information processing device 16 of the data center 15 repeatedly executes a process of a flowchart illustrated in FIG. 16 each time a predetermined time elapses.

The information processing device 16 performs a process of step 1601 on the respective traffic jam determination areas TJA-A, TJA-B. That is, the information processing device 16 calculates an average speed of all the vehicles 50 (smartphones 25) traveling in the respective traffic jam determination areas TJA-A, TJA-B over a seventh predetermined time and calculates an average value of the average speed of all the vehicles 50.

The information processing device 16 ending the process of step 1601 proceeds to step 1602 and determines whether or not the average value of the average speed of all the vehicles 50 is equal to or smaller than the traffic jam determination speed threshold value. When the information processing device 16 determines No in step 1602, the information processing device 16 temporarily ends the present routine.

When the information processing device 16 determines Yes in step 1602, the information processing device 16 proceeds to step 1603, and estimates that the traffic jam is caused in the target road (for example, the lane R2-A of the target road R2) in which the respective traffic jam determination areas TJA-A, TJA-B have been set.

The information processing device 16 ending the process of step 1603 proceeds to step 1604 and displays an indication that the traffic jam is caused in the target road in the current situation display portion DM-C of the road. The information processing device 16 ending the process of step 1604 temporarily ends the present routine.

Figure 17:
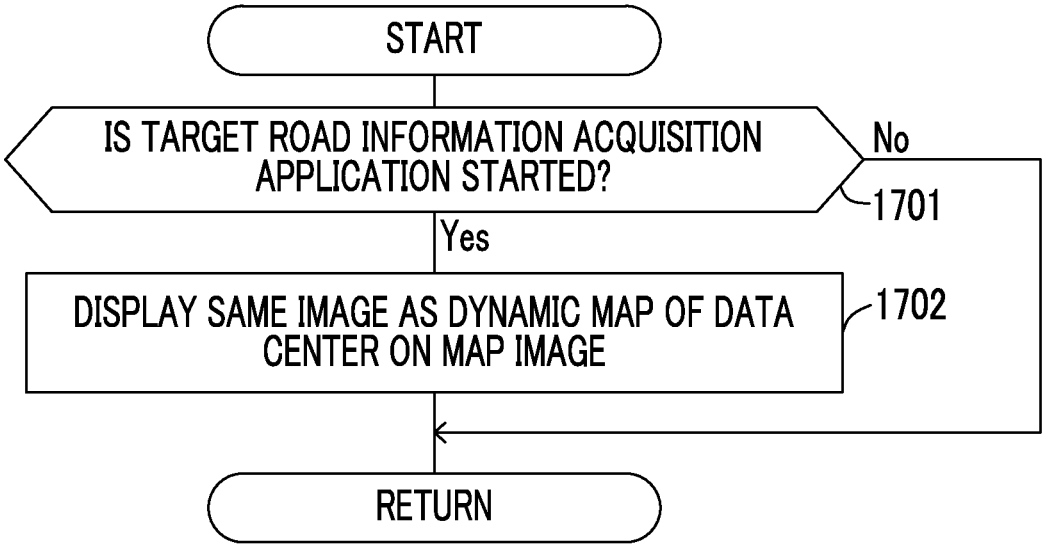
FIG. 17 is a flowchart illustrating a process that is executed by an ECU of a smartphone.

The ECU 27 of the smartphone 25 repeatedly executes a process of a flowchart illustrated in FIG. 17 each time a predetermined time elapses.

The ECU 27 determines whether or not the target road information acquisition application is read in step 1701. When the ECU 27 determines No in step 1701, the ECU 27 temporarily ends the present routine.

When the ECU 27 determines Yes in step 1701, the ECU 27 proceeds to step 1702 and displays the same image as the dynamic map DM of the data center 15, in the map image 31D. That is, for example, when information regarding traffic jam is displayed in the dynamic map DM, the ECU 27 displays information on the traffic jam in the map image 31D.

The ECU 27 ending the process of step 1702 temporarily ends the present routine.

The present disclosure is not limited to each of the embodiments, and various modification examples can be adopted within the scope of the present disclosure.

A standard of the radio waves generated and transmitted by the beacon 20 is not limited to Bluetooth Low Energy. For example, the standard of the radio waves may be Bluetooth (registered trademark).

The information terminal is not limited to the smartphone 25. For example, it is possible to use a tablet computer and a laptop type personal computer as the information terminal.

The information terminal (for example, the smartphone 25) may include an antenna capable of receiving information from an satellite of a global navigation satellite system (for example, Galileo) other than a GPS.

A information terminal installed in the area represented by the map image of the dynamic map DM may be used as the information terminal that calculates the estimated distance up to the beacon based on the radio signal transmitted by the beacon 20 and transmits the information on the estimated distance to the information processing device 16.

By the information processing device 16 releasing the information on the dynamic map DM in a specific web on the Internet and each smartphone 25 accessing the web over the Internet, the map image 31D of each smartphone 25 may display the same image as the dynamic map DM.

A target to which the beacon 20 is attached is not limited to the signboard 35. For example, the beacon 20 may be attached to a real estate (for example, a building) installed in the construction site.

Further, the information terminal (for example, the smartphone 25) may move together with a bicycle and/or a pedestrian.

The information processing device 16 calculates an acceleration of the smartphone 25 based on a change in the position on the dynamic map DM of the smartphone 25, and may estimate the current situation of the target road based on the acceleration and the map information of the dynamic map DM.

Further, an information terminal (for example, an information terminal having a navigation function) fixed to the vehicle (for example, a car or a motorcycle) may be used as the information terminal.

In the embodiment of the present disclosure, the information processing device may be configured to calculate derived information that is at least one of the velocity and the acceleration of the moving body correspondence information terminal based on the position information that is transmitted from the moving body correspondence information terminal, and estimate the current situation of the target road based on the derived information and the map information.

When the present disclosure is embodied in the embodiment, the information processing device can more accurately estimate a current situation of the target road.

In the embodiment of the present disclosure, the construction-related information estimation system may further include the beacon installed in the construction site, and including a transmission unit that transmits radio waves including a beacon ID signal that is its own identification information and a reference intensity signal indicating a radio wave intensity, and a plurality of distance estimation information terminals configured to receive radio waves transmitted by the beacon together with the beacon ID signal and the reference intensity signal, calculate an estimated distance that is a distance between the beacon corresponding to the beacon ID signal and the distance estimation information terminal based on an actual intensity of the received radio waves and the reference intensity signal, and transmit radio waves together with the terminal ID signal that is its own identification information, its own position information, the beacon ID signal, and the estimated distance. The information processing device may be configured to receive the terminal ID signal, a plurality of pieces of position information, the beacon ID signal, and a plurality of estimated distances transmitted by the distance estimation information terminals together, obtain the estimated position that is a position of the beacon based on the estimated distances and the pieces of position information transmitted by the distance estimation information terminals, and specify the estimated position as the construction site.

When the present disclosure is embodied in the embodiment, the position of the construction site can be specified using the position information of the beacon. Further, it is possible to estimate whether or not the construction is actually performed at the construction site using the position information of the beacon. That is, when the information processing device acquires information on the estimated position of the beacons from the distance estimation information terminal, the information processing device can estimate that the construction is actually performed at the construction site. On the other hand, when the information processing device does not acquire information on the estimated position of the beacon from the distance estimation information terminal, the information processing device can estimate that the construction is not actually performed at the construction site.

In the embodiment of the present disclosure, the construction-related information estimation system may further include a construction-related information terminal configured to move together with a construction-related moving body associated with a person who performs the construction at the construction site, and transmit a terminal ID signal that is its own identification information and its own position information. The information processing device may be configured to specify the position of the construction-related information terminal indicated by the position information as the construction site when the position of the construction-related information terminal indicated by the position information received from the construction-related information terminal is not changed for a first predetermined time or more.

When the present disclosure is embodied in the embodiment, the position of the construction site can be specified using the position information received from the construction-related information terminal. Further, when the position of the construction-related information terminal is not changed for the first predetermined time or more, the construction can be estimated to be actually performed at the position of the construction site or at a construction site near the position of the construction site. On the other hand, when the position of the construction-related information terminal has been changed within a time shorter than the first predetermined time, the construction can be estimated not to be actually performed at the construction site.

In the embodiment of the present disclosure, the moving body may be the vehicle, and the information processing device may be configured to estimate that the current situation of the target road is a situation in which the target road is under a one-way traffic regulation when a situation in which all the moving body correspondence information terminals moving on the target road move solely in one direction on the target road continues for a second predetermined time or more in a case where the vehicle is able to pass in both directions on the target road under regulations of a road traffic law.

When the present disclosure is embodied in the embodiment, the information processing device can estimate whether the target road is under a situation in which the target road is under a one-way traffic regulation.

In the embodiment of the present disclosure, the moving body may be the vehicle, and the information processing device may be configured to estimate that the current situation of the target road is a situation in which the target road is under a one-sided alternate traffic regulation when a situation in which a state in which all the moving body correspondence information terminals moving on the target road move solely in one direction on the target road continues for a third predetermined time or more, and a situation in which a state in which all the moving body correspondence information terminals moving on the target road move solely in another direction on the target road continues for a fourth predetermined time or more alternately continue in a case where the vehicle is able to pass in both directions on the target road under regulations of a road traffic law.

When the present disclosure is embodied in the embodiment, the information processing device can estimate whether or not the target road is under a situation in which the target road is under a one-sided alternate traffic regulation.

In the embodiment of the present disclosure, the moving body may be the vehicle, and the information processing device may be configured to estimate that the current situation of the target road is a situation in which the target road is under a traffic stop regulation when a situation in which the moving body correspondence information terminal moving together with the vehicle does not move on the target road continues for a fifth predetermined time or more.

When the present disclosure is embodied in the embodiment, the information processing device can estimate whether or not the target road is under a situation which the target road is under a traffic stop regulation.

What is claimed is:

1. A construction-related information estimation system comprising:

a moving body correspondence information terminal that is configured to move together with a moving body that moves on a target road, the target road being a road on which a construction site that is a place which is estimated to be under a construction is located or a road that is located near the construction site, and transmit terminal information including a terminal ID signal that is its own identification information and its own position information; and an information processing device configured to have map information including information on the construction site and the target road and receive the terminal ID signal and the position information transmitted from the moving body correspondence information terminal, wherein the information processing device is configured to estimate a current situation of the target road based on the terminal information and the map information acquired from the moving body correspondence information terminal, and the construction-related information estimation system, further comprising: a beacon installed in the construction site, and including a transmission unit that transmits radio waves including a beacon ID signal that is its own identification information and a reference intensity signal indicating a radio wave intensity; and a plurality of distance estimation information terminals configured to receive radio waves transmitted by the beacon together with the beacon ID signal and the reference intensity signal, calculate an estimated distance that is a distance between the beacon corresponding to the beacon ID signal and the distance estimation information terminal based on an actual intensity of the received radio waves and the reference intensity signal, and transmit radio waves together with the terminal ID signal that is its own identification information, its own position information, the beacon ID signal, and the estimated distance, wherein the information processing device is configured to receive the terminal ID signal, a plurality of pieces of position information, the beacon ID signal, and a plurality of estimated distances transmitted by the distance estimation information terminals together, obtain the estimated position that is a position of the beacon based on the estimated distances and the pieces of position information transmitted by the distance estimation information terminals, and specify the estimated position as the construction site.

2. The construction-related information estimation system according to claim 1, wherein the information processing device is configured to calculate derived information that is at least one of a velocity and an acceleration of the moving body correspondence information terminal based on the position information that is transmitted from the moving body correspondence information terminal, and estimate the current situation of the target road based on the derived information and the map information.

3. The construction-related information estimation system according to claim 1, wherein:

the moving body is a vehicle; and the information processing device is configured to estimate that the current situation of the target road is a situation in which the target road is under a one-way traffic regulation when a situation in which all the moving body correspondence information terminals moving on the target road move solely in one direction on the target road continues for a predetermined time or more in a case where the vehicle is able to pass in both directions on the target road under regulations of a road traffic law.

4. The construction-related information estimation system according to claim 1, wherein:

the moving body is a vehicle; and the information processing device is configured to estimate that the current situation of the target road is a situation in which the target road is under a one-sided alternate traffic regulation when a situation in which a state in which all the moving body correspondence information terminals moving on the target road move solely in one direction on the target road continues for a first predetermined time or more, and a situation in which a state in which all the moving body correspondence information terminals moving on the target road move solely in another direction on the target road continues for a second predetermined time or more alternately continue in a case where the vehicle is able to pass in both directions on the target road under regulations of a road traffic law.

5. The construction-related information estimation system according to claim 1, wherein:

the moving body is a vehicle; and the information processing device is configured to estimate that the current situation of the target road is a situation in which the target road is under a traffic stop regulation when a situation in which the moving body correspondence information terminal moving together with the vehicle does not move on the target road continues for a predetermined time or more.

6. A construction-related information estimation system comprising:

a moving body correspondence information terminal that is configured to move together with a moving body that moves on a target road, the target road being a road on which a construction site that is a place which is estimated to be under a construction is located or a road that is located near the construction site, and transmit terminal information including a terminal ID signal that is its own identification information and its own position information; and an information processing device configured to have map information including information on the construction site and the target road and receive the terminal ID signal and the position information transmitted from the moving body correspondence information terminal, wherein the information processing device is configured to estimate a current situation of the target road based on the terminal information and the map information acquired from the moving body correspondence information terminal, and the construction-related information estimation system, further comprising: a construction-related information terminal configured to move together with a construction-related moving body associated with a person who performs the construction at the construction site, and transmit a terminal ID signal that is its own identification information and its own position information, wherein the information processing device is configured to specify the position of the construction-related information terminal indicated by the position information as the construction site when the position of the construction-related information terminal indicated by the position information received from the construction-related information terminal is not changed for a predetermined time or more.

7. The construction-related information estimation system according to claim 6, wherein the information processing device is configured to calculate derived information that is at least one of a velocity and an acceleration of the moving body correspondence information terminal based on the position information that is transmitted from the moving body correspondence information terminal, and estimate the current situation of the target road based on the derived information and the map information.

8. The construction-related information estimation system according to claim 6, wherein:

the moving body is a vehicle; and the information processing device is configured to estimate that the current situation of the target road is a situation in which the target road is under a one-way traffic regulation when a situation in which all the moving body correspondence information terminals moving on the target road move solely in one direction on the target road continues for a predetermined time or more in a case where the vehicle is able to pass in both directions on the target road under regulations of a road traffic law.

9. The construction-related information estimation system according to claim 6, wherein:

the moving body is a vehicle; and the information processing device is configured to estimate that the current situation of the target road is a situation in which the target road is under a one-sided alternate traffic regulation when a situation in which a state in which all the moving body correspondence information terminals moving on the target road move solely in one direction on the target road continues for a first predetermined time or more, and a situation in which a state in which all the moving body correspondence information terminals moving on the target road move solely in another direction on the target road continues for a second predetermined time or more alternately continue in a case where the vehicle is able to pass in both directions on the target road under regulations of a road traffic law.

10. The construction-related information estimation system according to claim 6, wherein:

the moving body is a vehicle; and the information processing device is configured to estimate that the current situation of the target road is a situation in which the target road is under a traffic stop regulation when a situation in which the moving body correspondence information terminal moving together with the vehicle does not move on the target road continues for a predetermined time or more.

* * * * *